US012181249B2

(12) United States Patent
Marcu

(10) Patent No.: US 12,181,249 B2
(45) Date of Patent: Dec. 31, 2024

(54) ADJUSTABLE WINDAGE OPTICS MOUNT WITH EXTERNAL ADJUSTMENT TOOL

(71) Applicant: Mihai Marcu, Spring, TX (US)

(72) Inventor: Mihai Marcu, Spring, TX (US)

( * ) Notice: Subject to any disclaimer, the term of this patent is extended or adjusted under 35 U.S.C. 154(b) by 45 days.

(21) Appl. No.: 18/075,409

(22) Filed: Dec. 5, 2022

(65) Prior Publication Data

US 2023/0175819 A1 Jun. 8, 2023

Related U.S. Application Data

(60) Provisional application No. 63/286,560, filed on Dec. 6, 2021.

(51) Int. Cl.
*F41G 11/00* (2006.01)

(52) U.S. Cl.
CPC ..... *F41G 11/007* (2013.01); *F41G 11/003* (2013.01)

(58) Field of Classification Search
CPC ..... F41G 11/007; F41G 11/003
See application file for complete search history.

(56) References Cited

U.S. PATENT DOCUMENTS 2,425,130 A 8/1947 Shelley
2,951,292 A 9/1960 Buehler
3,256,608 A * 6/1966 Neisius ..... F41G 1/50 89/200
3,471,932 A 10/1969 Luning
3,922,794 A * 12/1975 Ackerman, Jr. ..... F41G 11/001 42/126
4,224,741 A * 9/1980 Perry ..... F41G 1/467 33/265
4,244,114 A * 1/1981 Strahan ..... F41G 1/425 42/137
4,317,304 A 3/1982 Bass
4,530,163 A * 7/1985 Hovey ..... F41G 1/467 33/265
5,063,677 A * 11/1991 Millett ..... F41G 1/28 42/137
5,086,566 A 2/1992 Klumpp
5,400,539 A 3/1995 Moore
5,428,915 A 7/1995 King
6,591,538 B2 * 7/2003 Holler ..... F41G 11/007 42/126
6,722,075 B1 * 4/2004 Gabaldon ..... F41G 1/01 42/141
6,732,987 B2 5/2004 Wooten et al.
6,772,550 B1 8/2004 Leatherwood
7,140,143 B1 11/2006 Ivey
(Continued)

*Primary Examiner* — Michelle Clement

(57) ABSTRACT

Disclosed herein is a windage-adjustable optics mount with at least one external windage adjustment tool. Further disclosed herein is a method of adjusting the windage of an aiming device mounted on an adjustable windage optics mount by way of an external windage adjustment tool. The external windage adjustment tool may provide a means for adjusting windage by incrementally pivoting one end of a rail, upon which an aiming device may be mounted, relative to an opposite end of the rail, thereby allowing the rail to function as a windage-adjustable rail. A windage-adjustable rail may include an optics mounting feature, for example a Picatinny rail (also known as MIL-STD-1913 rail), and an arrangement of holes and recesses necessary for alignment and for securing to a base member.

6 Claims, 35 Drawing Sheets

(56) References Cited

U.S. PATENT DOCUMENTS 7,543,405 B1 6/2009 Ivey
7,647,720 B1 * 1/2010 Vendetti ..... F41G 1/28 42/126
7,827,724 B1 * 11/2010 Spinelli ..... F41G 11/003 248/295.11
7,870,689 B2 * 1/2011 Dextraze ..... F41G 1/393 42/126
8,156,678 B2 * 4/2012 Hoel ..... F41G 11/003 42/124
8,240,075 B1 * 8/2012 Mullin ..... F41G 11/003 42/122
8,336,244 B2 12/2012 Peterson et al.
8,413,365 B2 * 4/2013 Jung ..... F41G 11/003 42/137
8,448,374 B2 * 5/2013 Samson ..... F41G 11/003 42/138
8,695,265 B2 * 4/2014 Dextraze ..... F41C 27/00 42/117
8,707,606 B2 * 4/2014 Hoel ..... F41G 11/003 42/124
8,720,103 B2 5/2014 Schultz et al.
8,726,562 B1 5/2014 Hoskisson
8,763,299 B2 * 7/2014 Clifton ..... F41G 11/003 42/125
D715,887 S * 10/2014 Friedman ..... D22/109
9,453,709 B2 * 9/2016 Hamm ..... F41G 11/003
9,459,075 B1 * 10/2016 Hatcher ..... F41G 1/48
9,759,524 B2 9/2017 Culp
10,107,596 B2 10/2018 Greenwood
10,317,163 B2 * 6/2019 Poindexter ..... F41A 23/02
D877,843 S 3/2020 Yu
10,663,255 B2 * 5/2020 Brown ..... F41G 3/06
10,663,256 B1 * 5/2020 Garbouchian ..... F41G 1/425
11,543,212 B1 * 1/2023 Letts ..... F41G 11/003
11,703,308 B2 * 7/2023 Ding ..... F41G 11/003 42/90
2006/0179703 A1 * 8/2006 Leatherwood ..... F41G 11/003 42/124
2009/0205240 A1 8/2009 Dextraze
2010/0162611 A1 * 7/2010 Samson ..... F41G 11/003 42/125
2015/0253104 A1 * 9/2015 Holland ..... F41G 11/003 42/71.01
2018/0087875 A1 * 3/2018 Yost ..... F41G 1/26
2023/0184517 A1 * 6/2023 Davis ..... F41G 1/02 42/90

* cited by examiner

ADJUSTABLE WINDAGE OPTICS MOUNT WITH EXTERNAL ADJUSTMENT TOOL

FIELD OF THE INVENTION

The present invention pertains to an accessory for a firearm and, more specifically, it pertains to an optics mount for a firearm.

BACKGROUND OF THE INVENTION

It is well known to use various aiming devices, such as electro-optic sights and laser illuminators, with firearms. Such aiming devices can be mounted to an accessory mount directly securable to the side rail of a firearm or to other types of engaging mechanisms. For the point of impact of the projectile to coincide with the point of aim observed by the shooter, the axis, or the line of sight of the aiming device must be aligned with the axis of the firearm's barrel. Consequently, the axis of the firearm's side rail (or other type of engaging mechanism) traditionally must be also aligned with the axis of the firearm's barrel so that the line of sight of the aiming device is aligned with the firearm's barrel.

Certain types of firearms are known for being produced with large manufacturing and assembly tolerances, resulting in significant misalignments between the axis of the side rail and the axis of the barrel.

Some types of aiming devices are provided with internal mechanisms that allow for windage and elevation adjustments within a limited range relative to their center axis or line of sight, and some types of aiming devices lack an internal mechanism necessary for elevation and windage adjustments. Where available, the internal adjusting mechanism of the aiming device can be used to some extent to correct the misalignment between the side rail and the axis or the line of sight of the aiming device. However, correcting the misalignment between the side rail and the axis or the line of sight of the aiming device by a specific amount, using the internal mechanism of the aiming device, reduces the initial adjustment range of the aiming device by an equal amount. Moreover, the accuracy of the internal adjustment mechanisms decreases when they approach the outer limits of their adjustment ranges such that approaching the outer limit in one direction (for example windage) reduces the adjustment range in the other direction (for example elevation). Such adjustments by way of internal mechanisms may require using the entire range of adjustment provided by the internal mechanism of the aiming device to correct or partially correct extreme misalignments of the firearm's side rail relative to the axis of the firearm's barrel, which is a phenomenon known among shooters as "running out of adjustments."

Accordingly, there exists a need for an accessory mount for permitting the alignment of the axis or the line of sight of the aiming device with the axis of the firearm's barrel in situations where the axis of the side rail and the axis of the barrel are out of alignment, thus preserving the adjustment range of the internal mechanism of the aiming device.

SUMMARY OF THE INVENTION

Disclosed herein is a windage-adjustable optics mount with external windage adjustment tool. The optics mount may include a base member attachable to a side rail of a firearm, a windage-adjustable rail and an external windage adjustment tool. In one preferred embodiment, the base member comprises a first engaging member releasably attached to a side rail of a firearm, and a second engaging member fastened to the first engaging member. A windage-adjustable rail may include an optics mounting feature, for example a Picatinny rail (also known as MIL-STD-1913 rail), and an arrangement of holes and recesses necessary for alignment and for securing to the second engaging member. An external adjustment tool may include a bracket, a pivot screw, a two-way bracket, an adjustment screw, a dial disk, and threaded fasteners. Further disclosed herein is a method of adjusting the windage of an aiming device mounted on an adjustable windage optics mount by way of an external adjustment tool. The method may include positioning an external adjustment tool onto an adjustable windage optics mount and incrementally pivoting one end of a rail relative to an opposite end of a rail by turning an adjustment screw.

DETAILED DESCRIPTION

Figure 1:
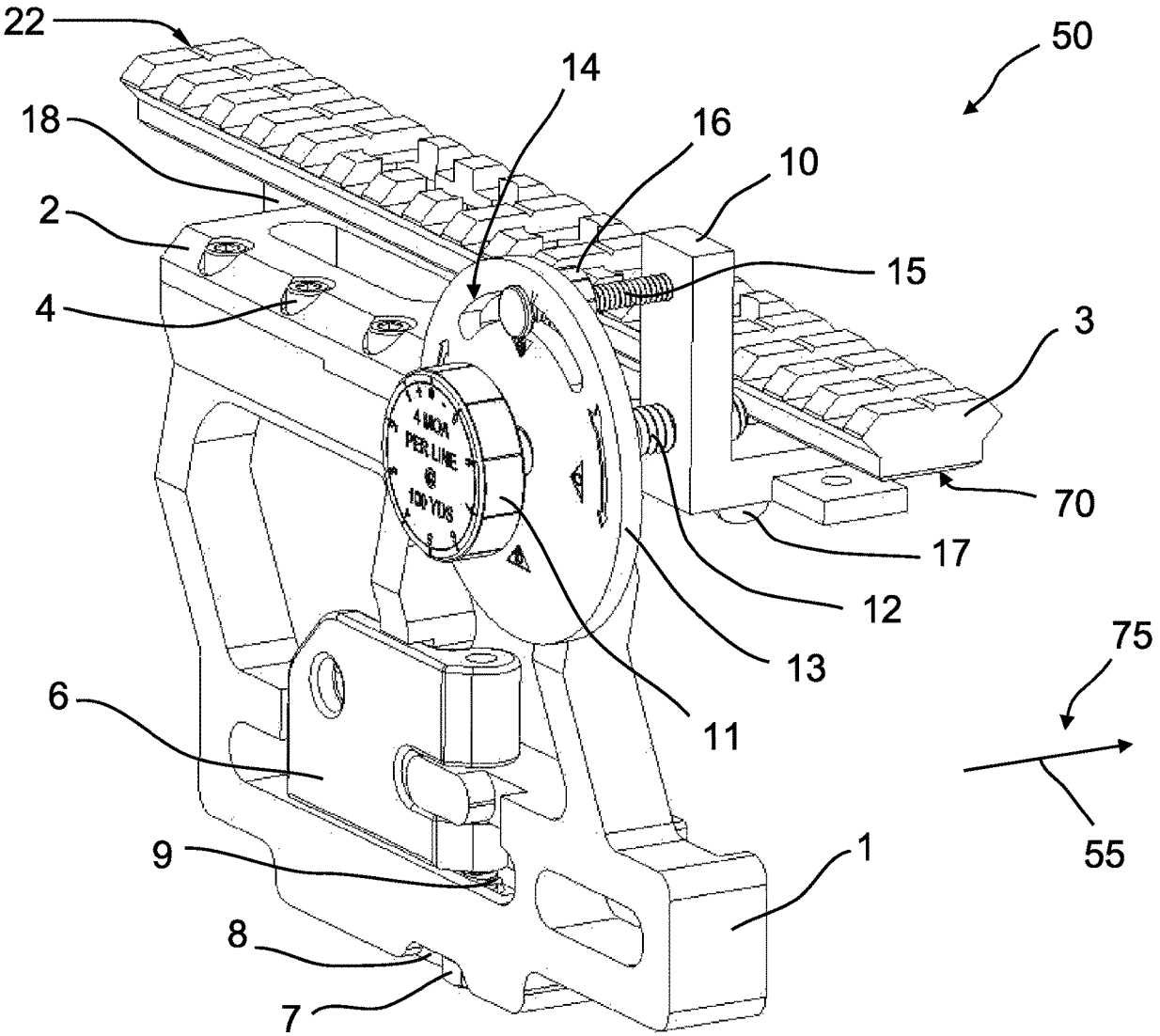
FIG. 1 is an elevated left-side perspective view of an embodiment of a windage-adjustable optics mount with an external windage adjustment tool, shown together with a directional key, where an external windage adjustment tool is situated in a position that allows for windage adjustment in a direction indicated by the key.
Figure 8:
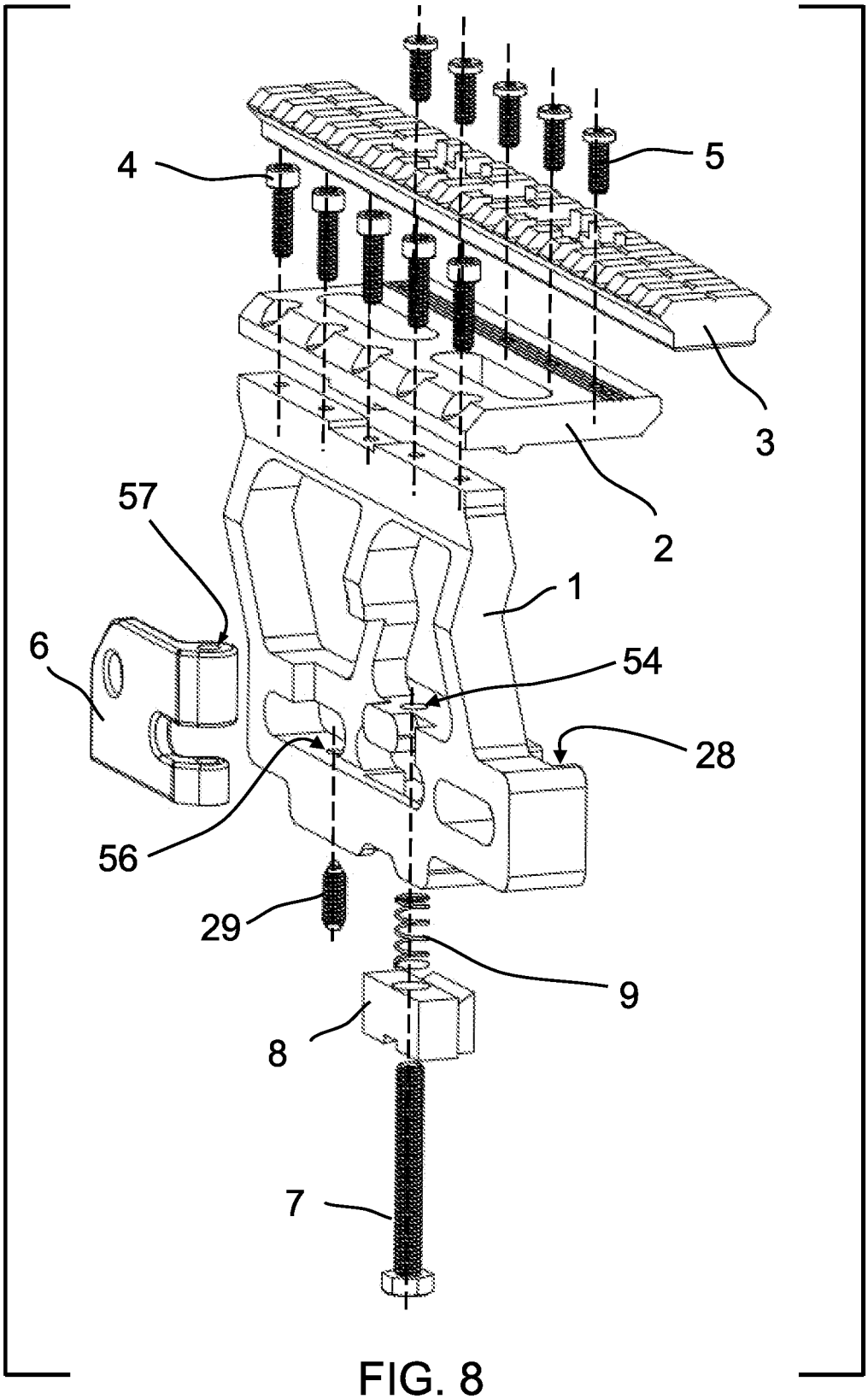
FIG. 8 is an exploded elevated left-side perspective view of an embodiment of a windage-adjustable optics mount of FIG. 1 with no external windage adjustment tool present.
Figure 9:
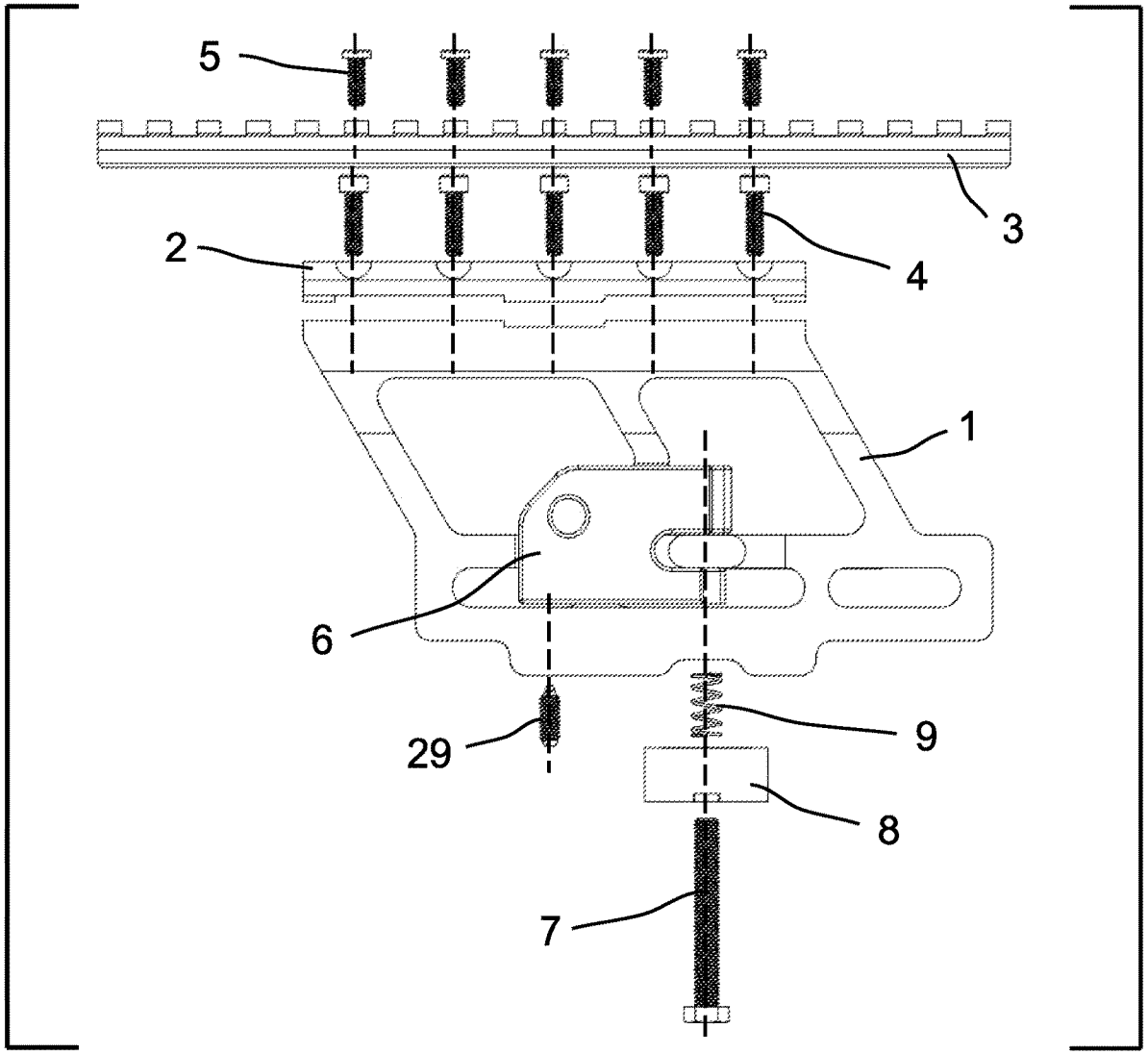
FIG. 9 is an exploded left-side view of an embodiment of a windage-adjustable optics mount similar to what is shown in FIG. 8.
Figure 10:
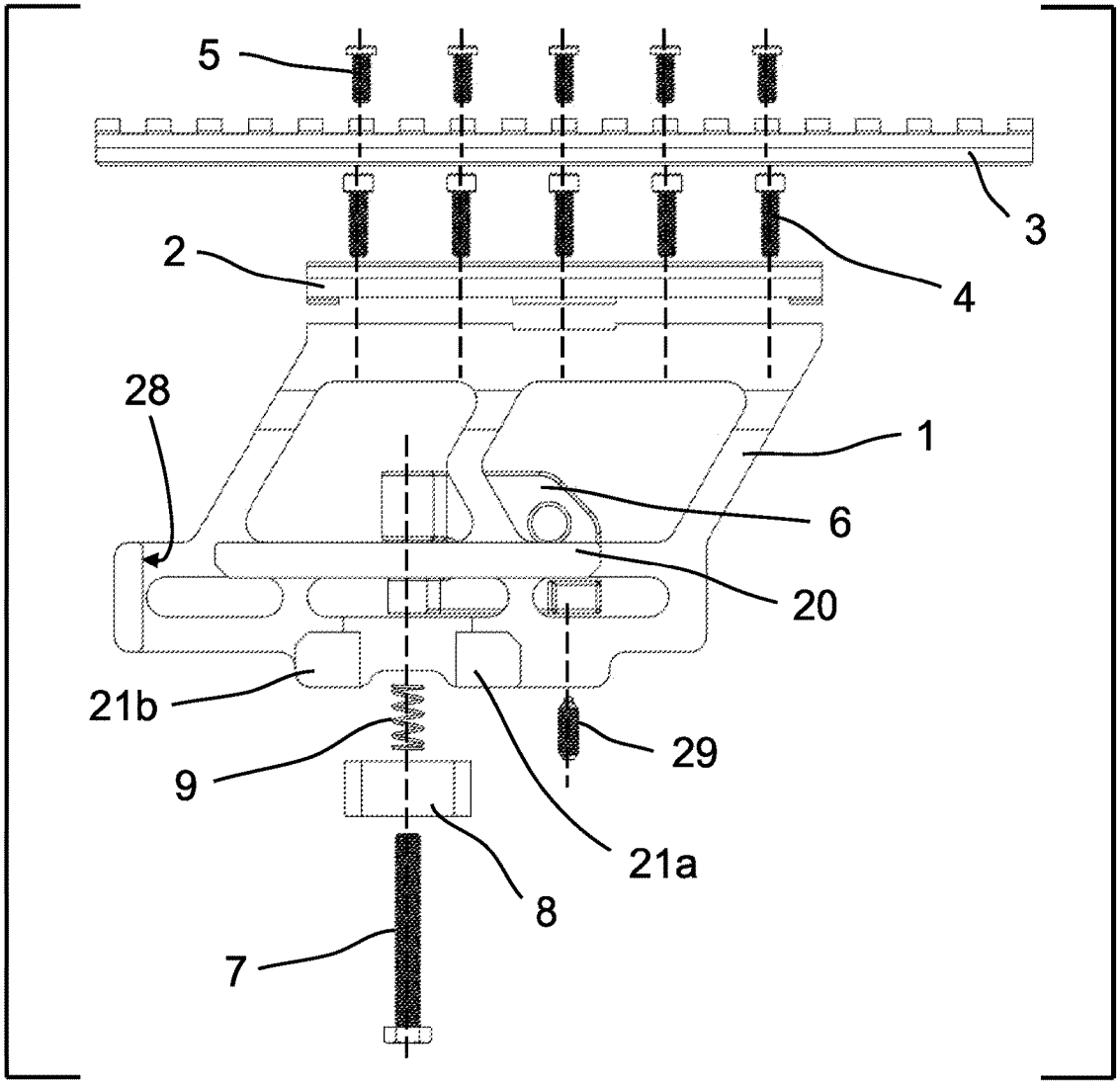
FIG. 10 is an exploded right-side view of an embodiment of a windage-adjustable optics mount similar to what is shown in FIG. 8.

An embodiment of a windage-adjustable optics mount with external windage adjustment tool in accordance with the present invention is shown as 50 in FIG. 1. In this embodiment, optics mount 50 includes first engaging member 1, second engaging member 2 that is fastened to the first engaging member 1 with a plurality of screws 4, and Picatinny rail 3 that is fastened to second engaging member 2. Picatinny rail 3 is fastened to second engaging member 2 with a plurality of screws 5 (illustrated, for example, in FIG. 6B and in FIG. 8).

Figure 11:
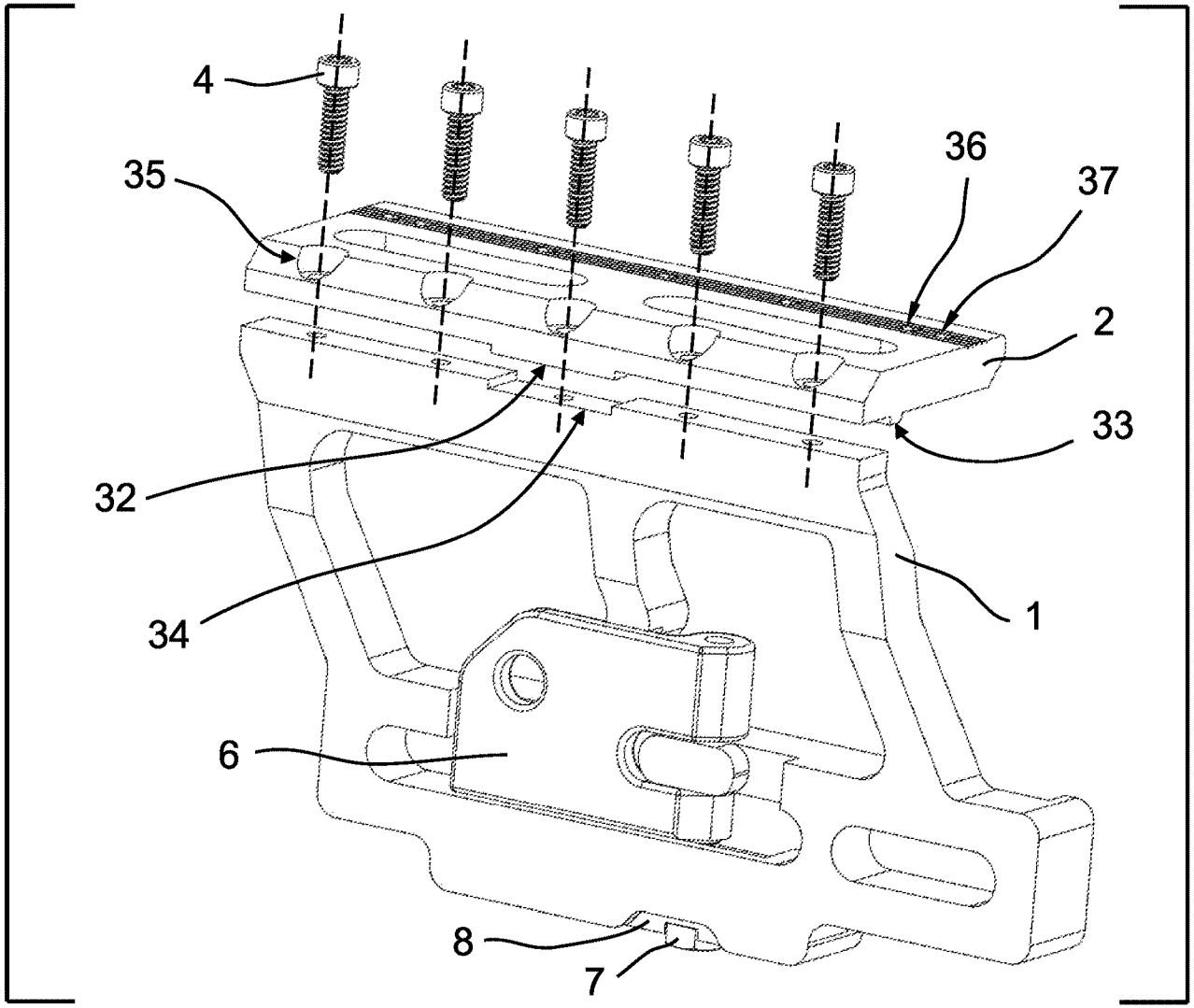
FIG. 11 is an exploded partial view of an embodiment of a windage-adjustable optics mount showing an embodiment of an interlocking mechanism and a fastening mechanism that enable the engagement of a second engaging member to a first engaging member of a base and prevent the movement of the second engaging member relative to the first engaging member.
Figure 12:
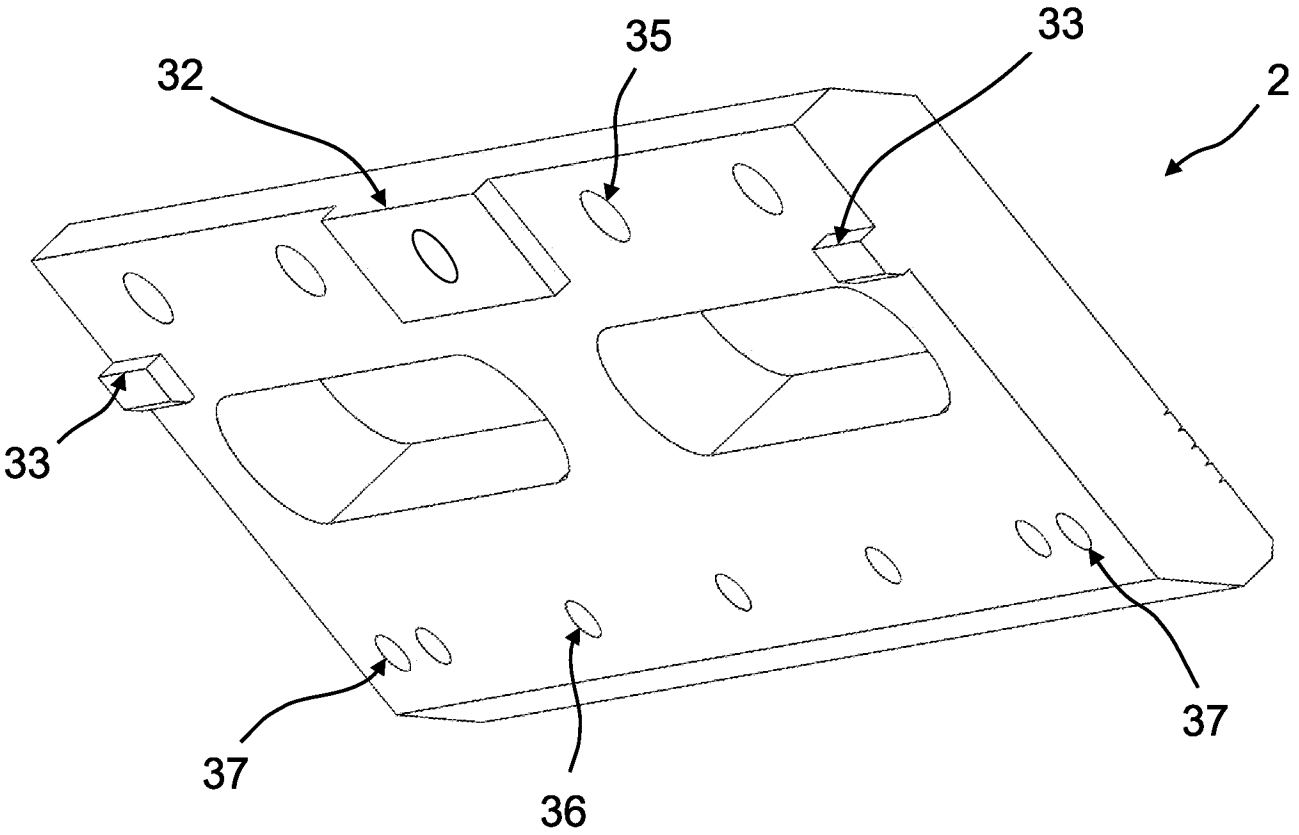
FIG. 12 illustrates a bottom perspective view of an embodiment of a second engaging member of an optics mount base, showing an embodiment of an interlocking mechanism with a first engaging member and an embodiment of the features enabling the fastening of a Picatinny rail and of an external windage adjustment tool.

FIG. 11 is an exploded partial view of an embodiment of a windage-adjustable optics mount 50, showing an interlocking mechanism and fastening mechanism that enable the engagement of second engaging member 2 to the first engaging member 1 and prevent the movement of second engaging member 2 relative to the first engaging member 1. In this embodiment, an interlocking mechanism may be comprised of a female portion 34 machined into the first engaging member 1, mating male portion 32, and two lugs 33 that are part of second engaging member 2 (illustrated, for example, in FIG. 12).

Figure 2:
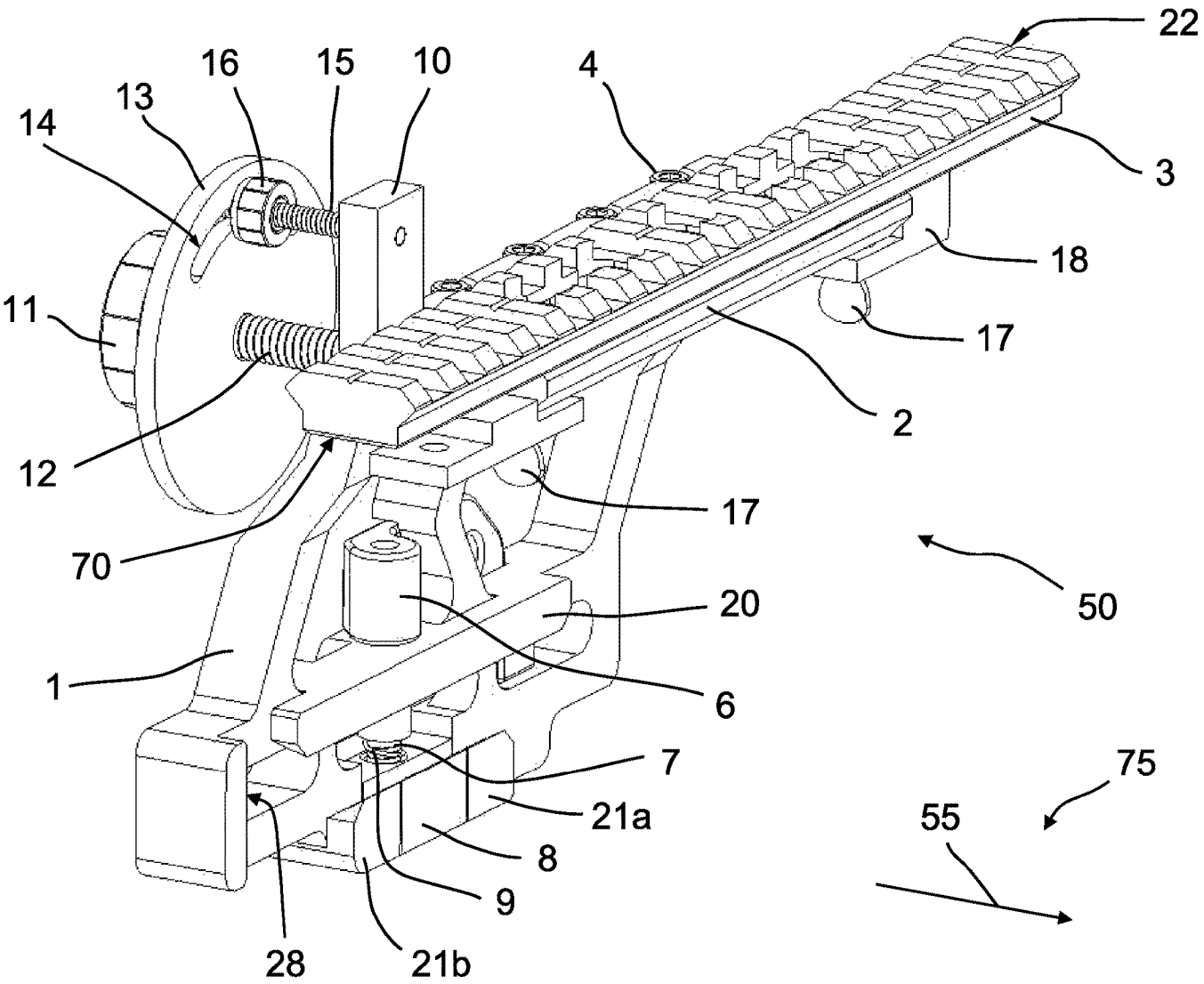
FIG. 2 is an elevated right-side perspective view of an embodiment of a windage-adjustable optics mount with an external windage adjustment tool similar to what is shown in FIG. 1.

FIG. 2 is an elevated right side perspective view of an embodiment of a windage-adjustable optics mount with an external windage adjustment tool similar to what is shown in FIG. 1. An external windage adjustment tool may comprise a rear subassembly and a front subassembly. The terms "rear" and "front" are based upon the orientation of optics mount 50 secured to side rail 48 of a firearm as illustrated, for example, in FIG. 29, where in that embodiment the term "rear" is identified as adjacent to a buttstock 49, and the term "front" is identified as adjacent to barrel 41. A rear subassembly may include two-way mounting bracket 10, dial knob 11, adjustment screw 12, disk 13, screw 15, thumb nut 16 and thumb screw 17. A front subassembly may include bracket 18, pivot screw 19 (not shown) and thumb screw 17. FIGS. 1-2 illustrate an optics mount 50, together with directional key 75, and an external windage adjustment tool situated in a position that enables windage adjustment by pushing rear end 70 of Picatinny rail 3 in lateral direction 55 indicated by the directional key 75.

Figure 6B:
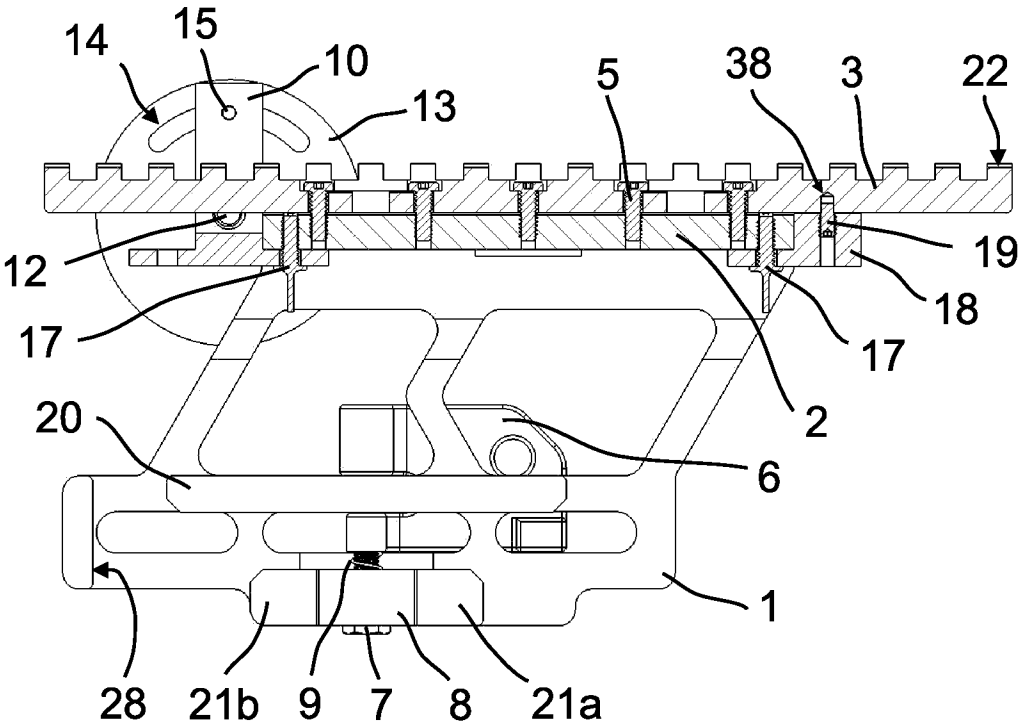
FIG. 6B is a cross-sectional view, taken across the dotted line labelled 45-45 in FIG. 6A, of an embodiment of a windage-adjustable optics mount with an external windage adjustment tool similar to what is shown in FIG. 6A.
Figure 6A:
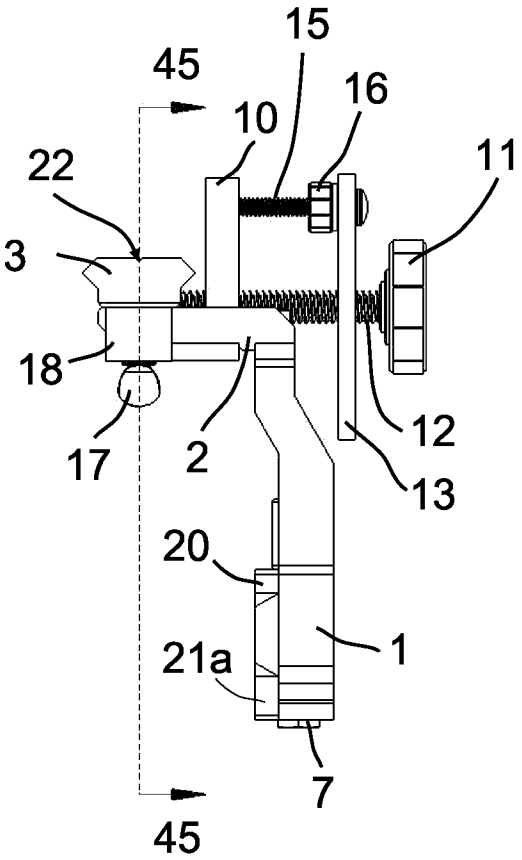
FIG. 6A illustrates a front view of an embodiment of a windage-adjustable optics mount with an external windage adjustment tool similar to what is shown in FIG. 1.

FIG. 6B is a cross-sectional view, taken across the dotted line labelled 45-45 in FIG. 6A, of an embodiment of a windage-adjustable optics mount with external windage adjustment tool similar to what is shown in FIG. 6A. As illustrated in this embodiment, Picatinny rail 3 is fastened to second engaging member 2 with a plurality of screws 5 threaded into holes 36. Two-way mounting bracket 10 and bracket 18 may be secured to second engaging member 2 with thumb screws 17. Pivot screw 19 threaded into bracket 18 may engage hole 38 in Picatinny rail 3 and provides a pivot point during a windage adjustment procedure, embodiments of which will be explained subsequently in connection with FIGS. 20-21 and FIGS. 24-25.

Figure 13:
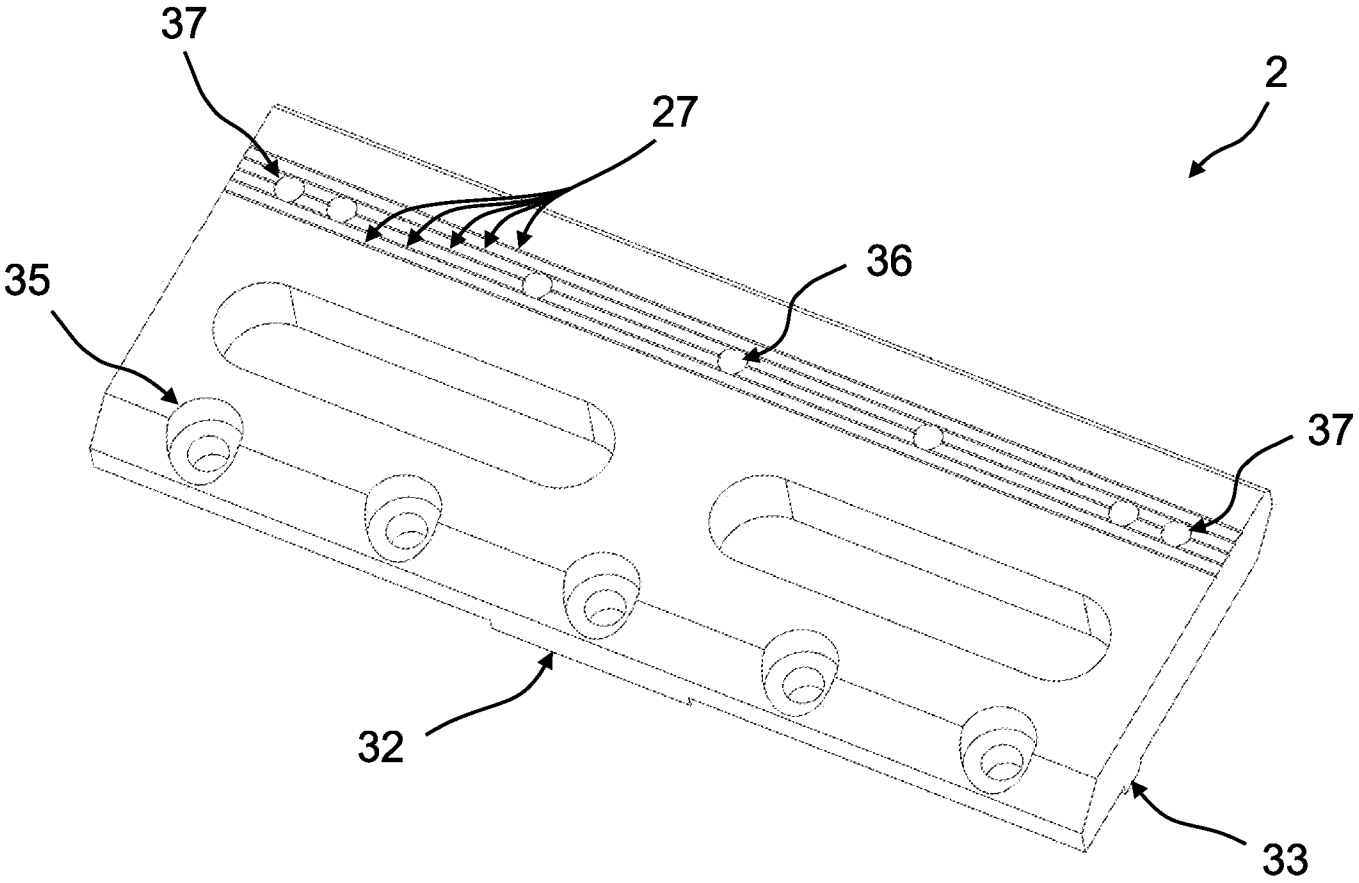
FIG. 13 illustrates an elevated perspective view of an embodiment of a second engaging member of an optics mount base, showing an embodiment of an interlocking mechanism with a first engaging member and an embodiment of the features enabling the alignment and fastening of a Picatinny rail and of an external windage adjustment tool.
Figure 31:
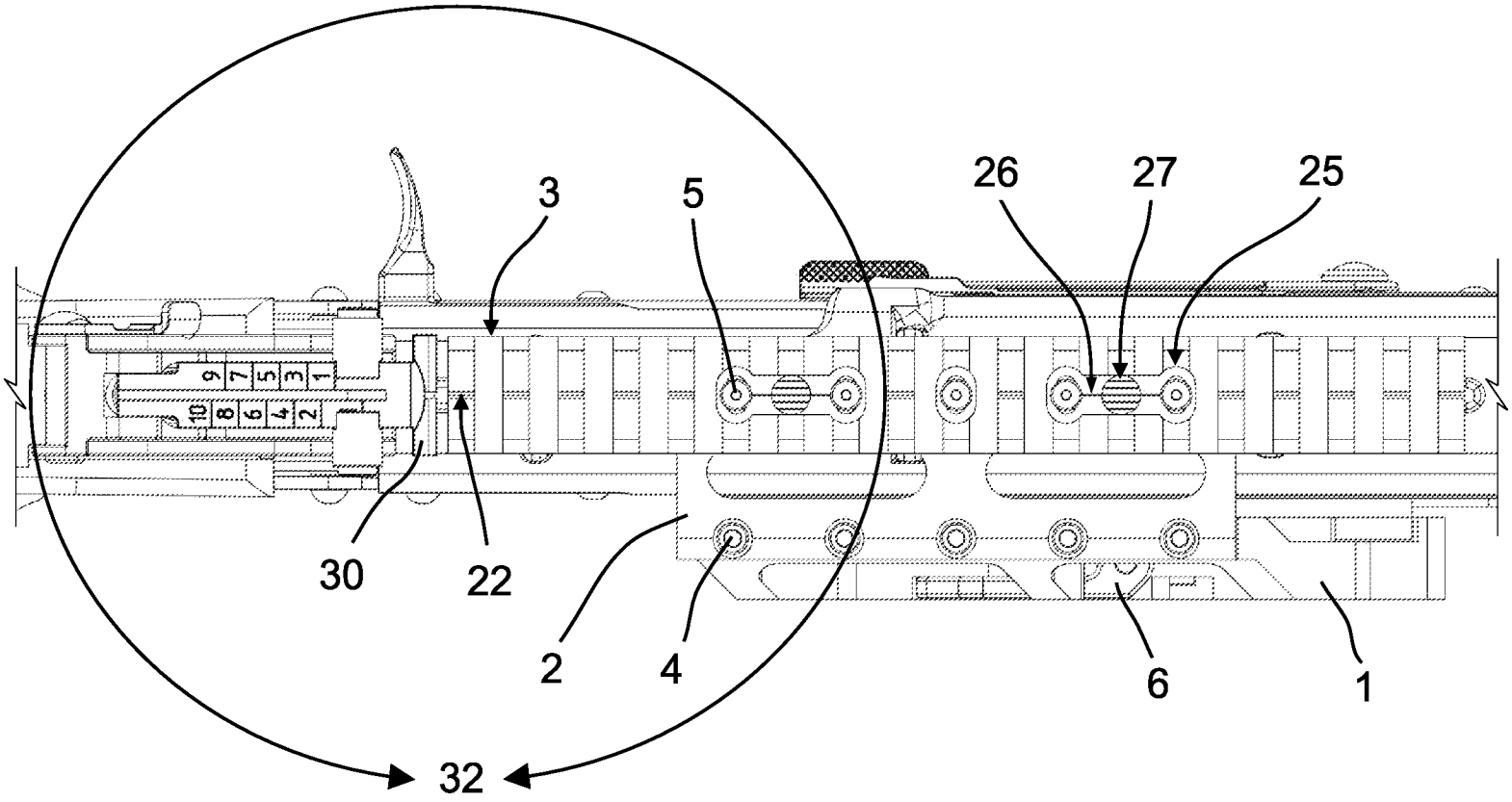
FIG. 31 is a top partial view of an embodiment of a windage-adjustable optics mount in a fully engaged position with a firearm similar to what is illustrated in FIG. 29.
Figure 32:
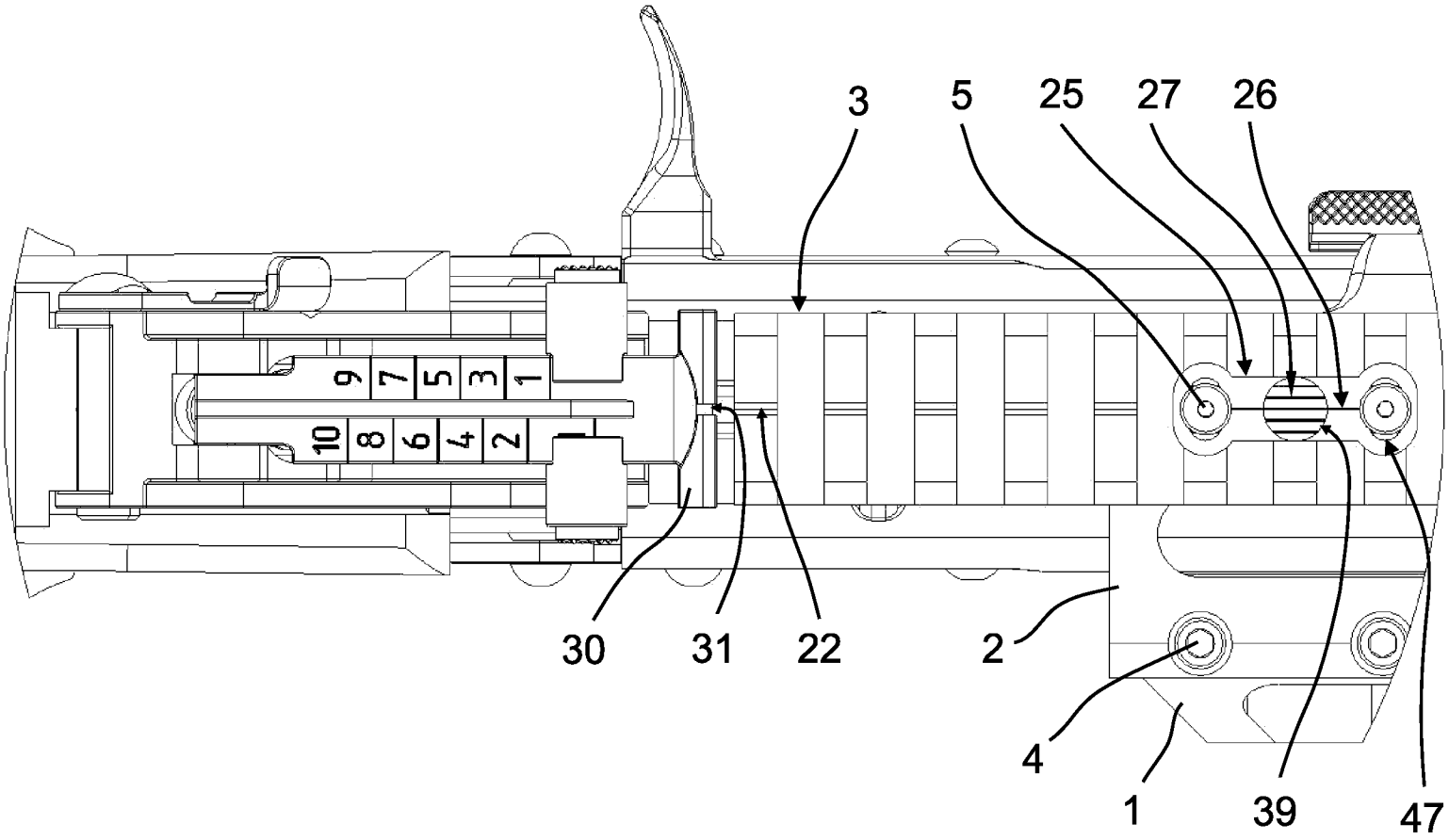
FIG. 32 is a partial and enlarged view of an embodiment of a windage-adjustable optics mount in a fully engaged position with a firearm similar to what is illustrated in FIG. 31.
Figure 33:
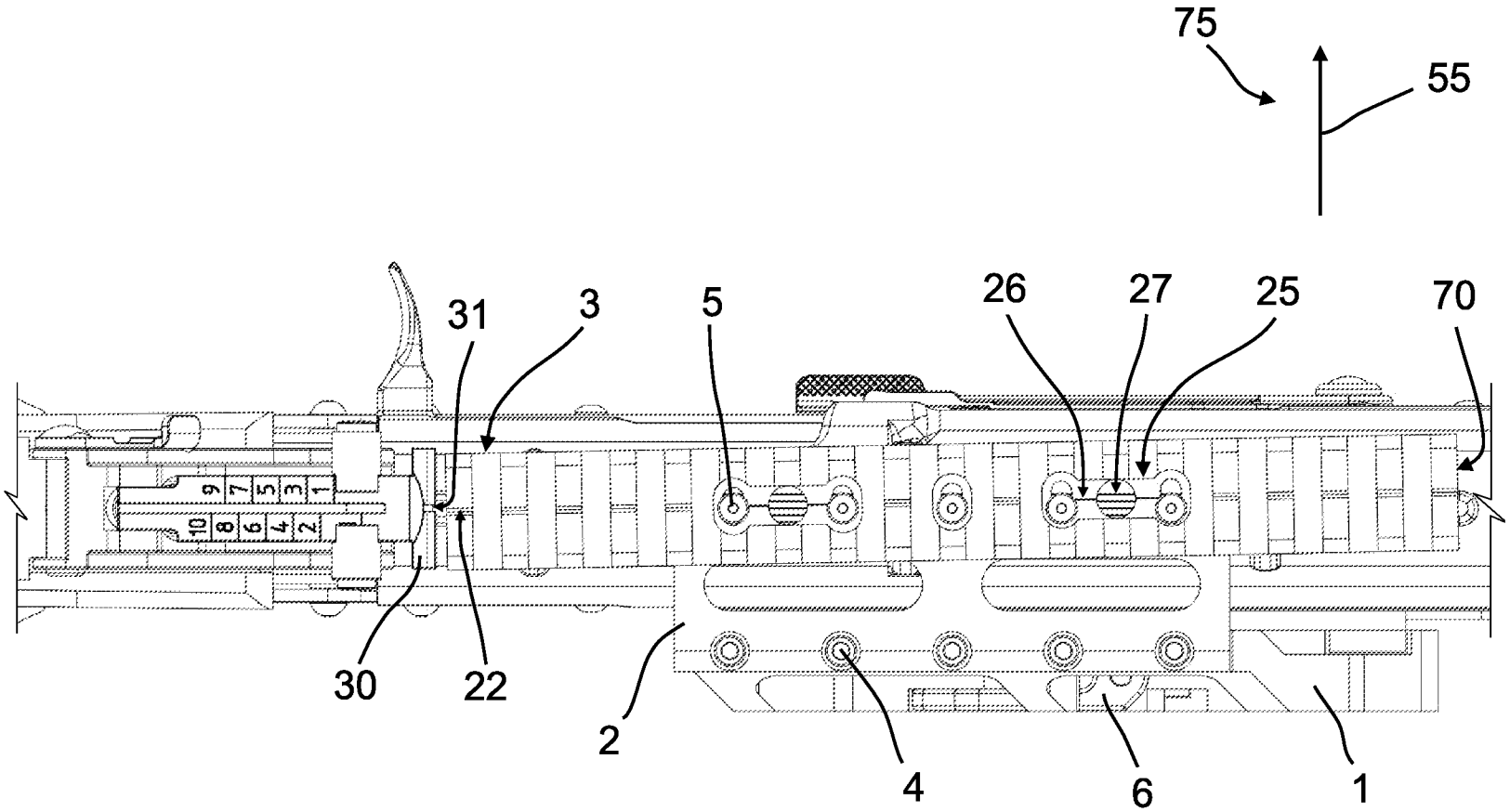
FIG. 33 is a top partial view of an embodiment of a windage-adjustable optics mount in a fully engaged position with a firearm similar to what is illustrated in FIG. 29, shown together with a directional key, where the windage may be adjusted by pushing a rear end of a Picatinny rail in a direction indicated by the key using an external windage adjustment tool.
Figure 34:
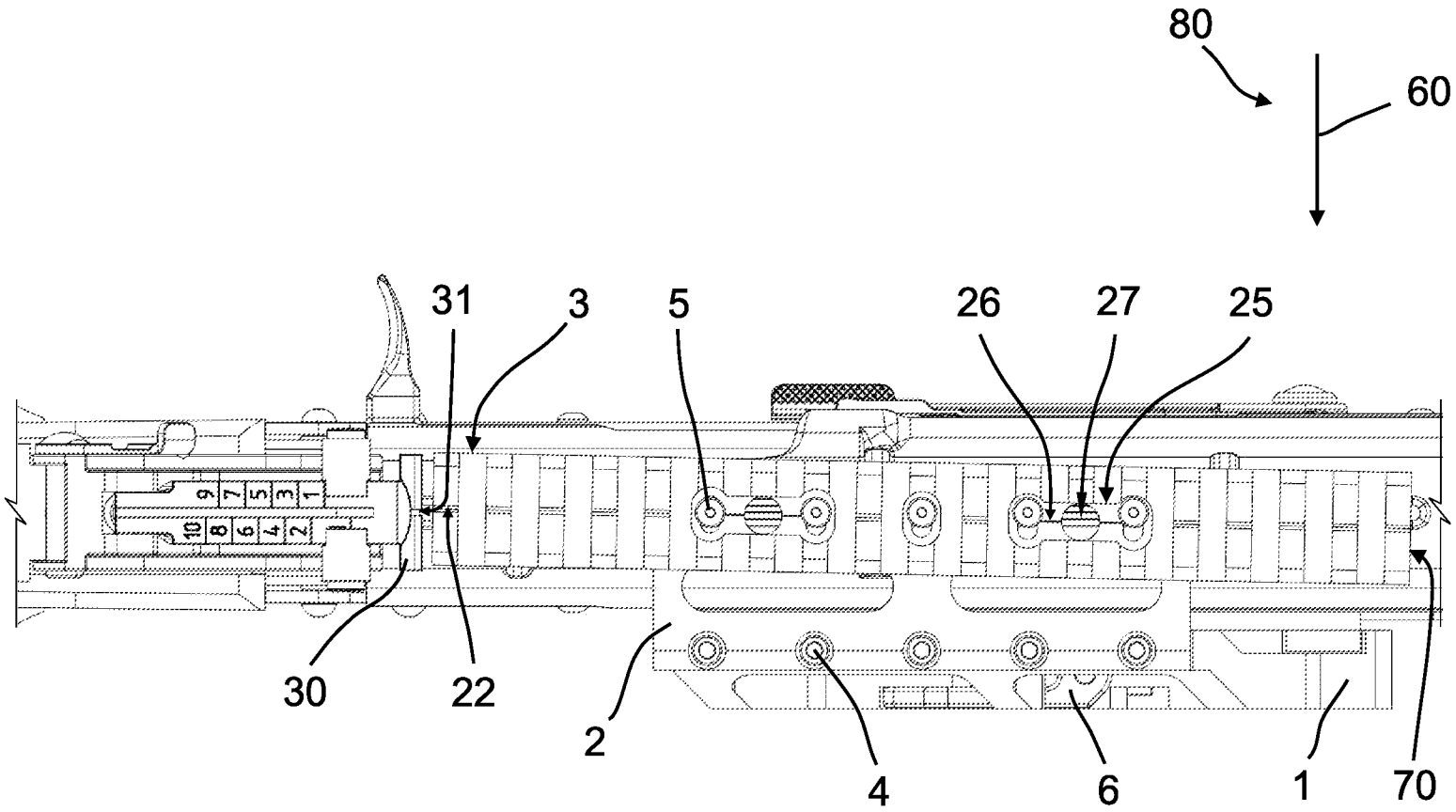
FIG. 34 is a top partial view of an embodiment of a windage-adjustable optics mount in a fully engaged position with a firearm similar to what is illustrated in FIG. 29, shown together with a directional key, where the windage may be adjusted by pushing a rear end of a Picatinny rail in a direction indicated by the key using an external windage adjustment tool.

FIG. 13 is an elevated perspective view of an embodiment of second engaging member 2 of an optics mount, showing a plurality of markings 27 used for aligning Picatinny rail 3 with notch 31 of rear sight 30 of a firearm (shown for example in FIGS. 31-34), embodiments of which will be explained subsequently in connection with FIG. 32.

Figure 14:
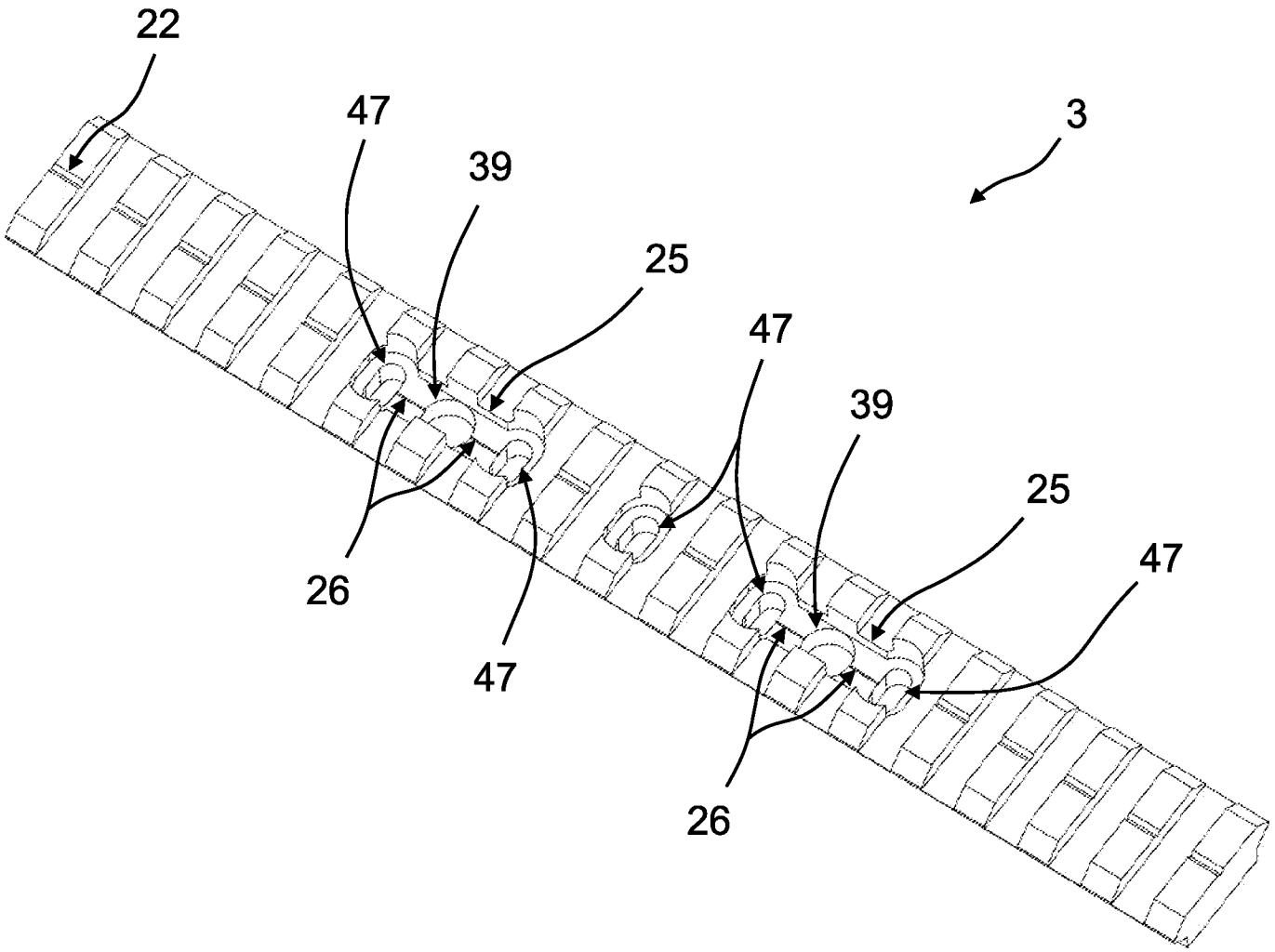
FIG. 14 illustrates a perspective top view of an embodiment of an adjustable Picatinny rail showing an embodiment of the features enabling the alignment with a firearm's rear sight and the fastening to a second engaging member of an optics mount base member.

FIG. 14 is an elevated perspective view of an embodiment of Picatinny rail 3. In this embodiment, notch 22 and elongated holes 47 may be used for positioning a front end of Picatinny rail 3 in axial alignment with notch 31 of rear sight 30 of a firearm, and viewing holes or viewing ports 39 in conjunction with markings 26 may be used for aligning Picatinny rail 3 with one of the markings 27 of second engaging member 2 (illustrated, for example, in FIG. 32). Recesses 25 permit the installation of screws 5 in a sunken position into Picatinny rail 3 (illustrated, for example, in FIG. 6B) to allow the attachment of aiming devices at any location within the length of Picatinny rail 3.

Figure 15:
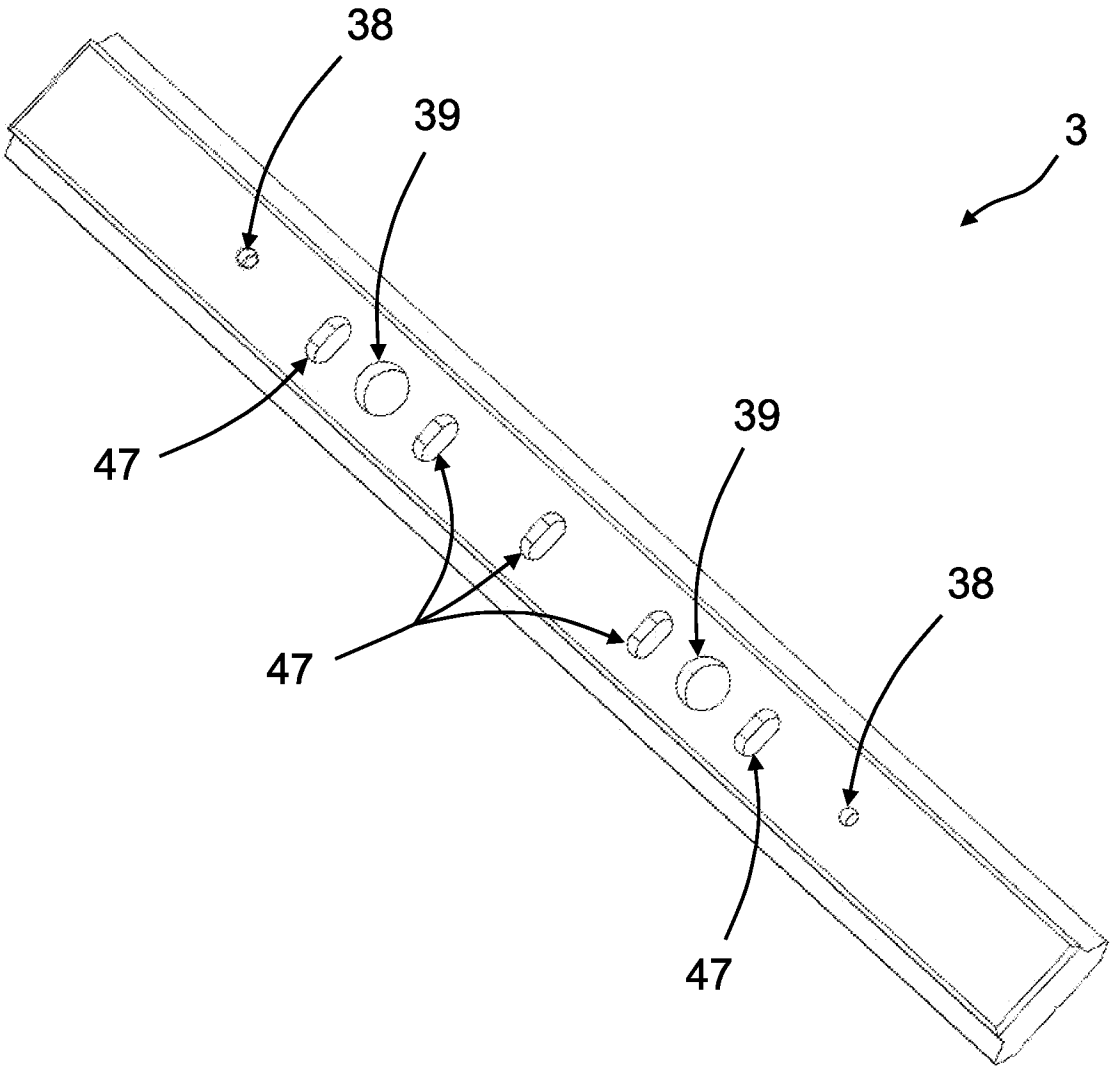
FIG. 15 illustrates a perspective bottom view of an embodiment of an adjustable Picatinny rail showing an embodiment of the features enabling the alignment with a firearm's rear sight and an adjustment of the windage.

FIG. 15 is a perspective bottom view of an embodiment of adjustable Picatinny rail 3. In this embodiment, hole 38 may be engaged by the tip of pivot screw 19 and installed into bracket 18 (illustrated, for example, in FIG. 6B and in FIG. 7), thus providing a pivoting point during the windage adjustment procedure, embodiments of which will be explained subsequently in connection with FIGS. 20-21 and FIGS. 24-25.

In one embodiment, an external windage adjustment tool is temporarily installed on optics mount 50 for the purpose of adjusting the windage of the aiming device, and it may be removed after the process is completed.

Figure 7:
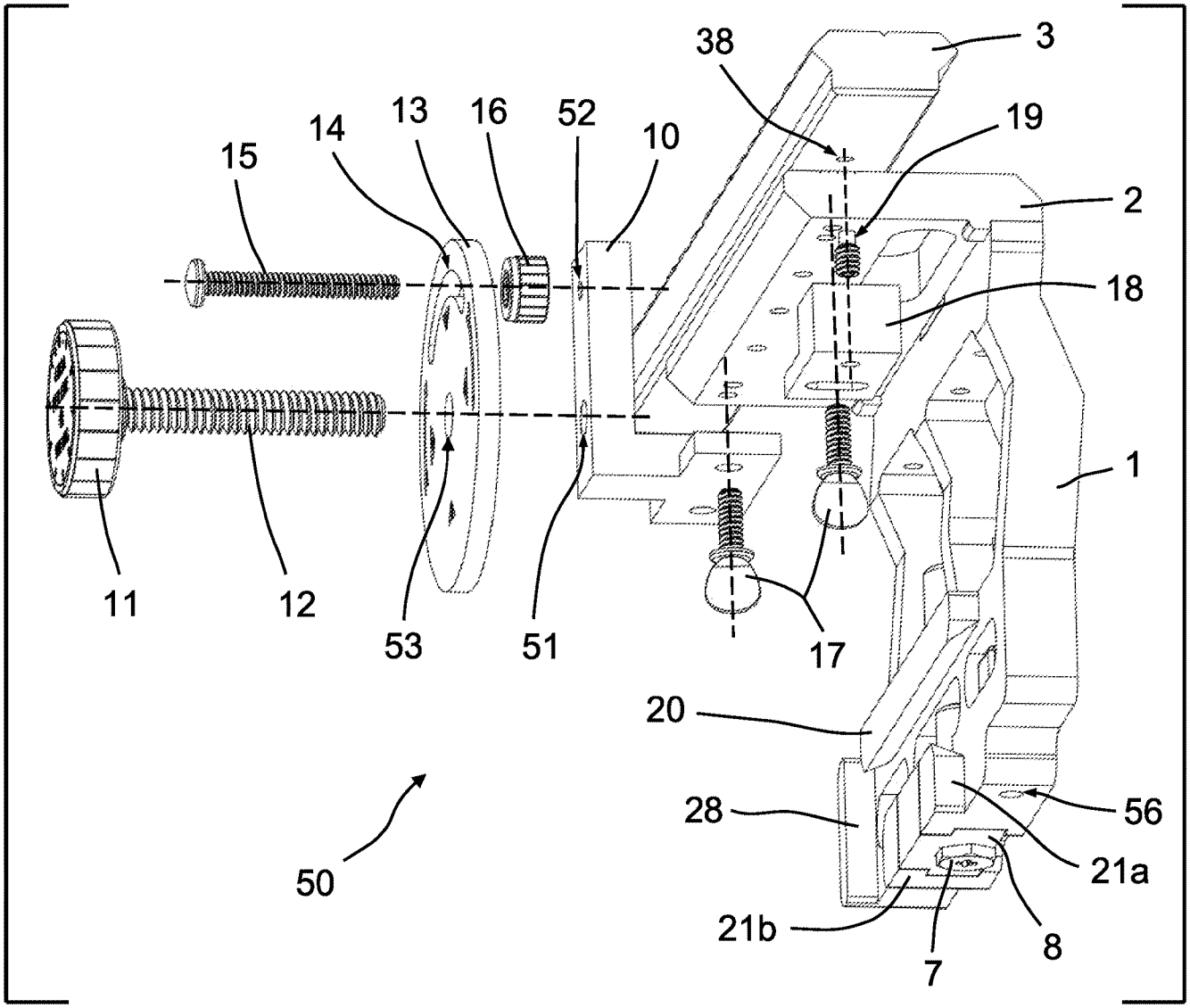
FIG. 7 is an exploded, rotated perspective view of an embodiment of a windage-adjustable optics mount with an external windage adjustment tool similar to what is shown in FIG. 3.

FIG. 7 is an exploded rotated perspective view of an embodiment of a windage-adjustable optics mount 50 with external windage adjustment tool. In this embodiment, the external windage adjustment tool comprises a rear subassembly and a front subassembly. The front subassembly may include bracket 18, pivot screw 19 and thumb screw 17. Pivot screw 19 may be installed into bracket 18 and engage hole 38 in Picatinny rail 3 when bracket 18 is fastened to second engaging member 2 with thumb screw 17 threaded in hole 37 (illustrated, for example, in FIG. 6B and FIG. 7). The rear subassembly may include two-way mounting bracket 10, dial knob 11, adjustment screw 12, disk 13, screw 15, thumb nut 16 and thumb screw 17. As shown in FIG. 7, adjustment screw 12 may be inserted through hole 53 in the center of disk 13, and then screwed into threaded hole 51 of two-way bracket 10. Screw 15 may be inserted through slot 14 of disk 13, where thumb nut 16 then may be installed on screw 15. Screw 15 may be then screwed into threaded hole 52 of two-way bracket 10. The rear subassembly may be fastened to second engaging member 2 by way of thumb screw 17 (illustrated, for example, in FIG. 6B).

Figure 4:
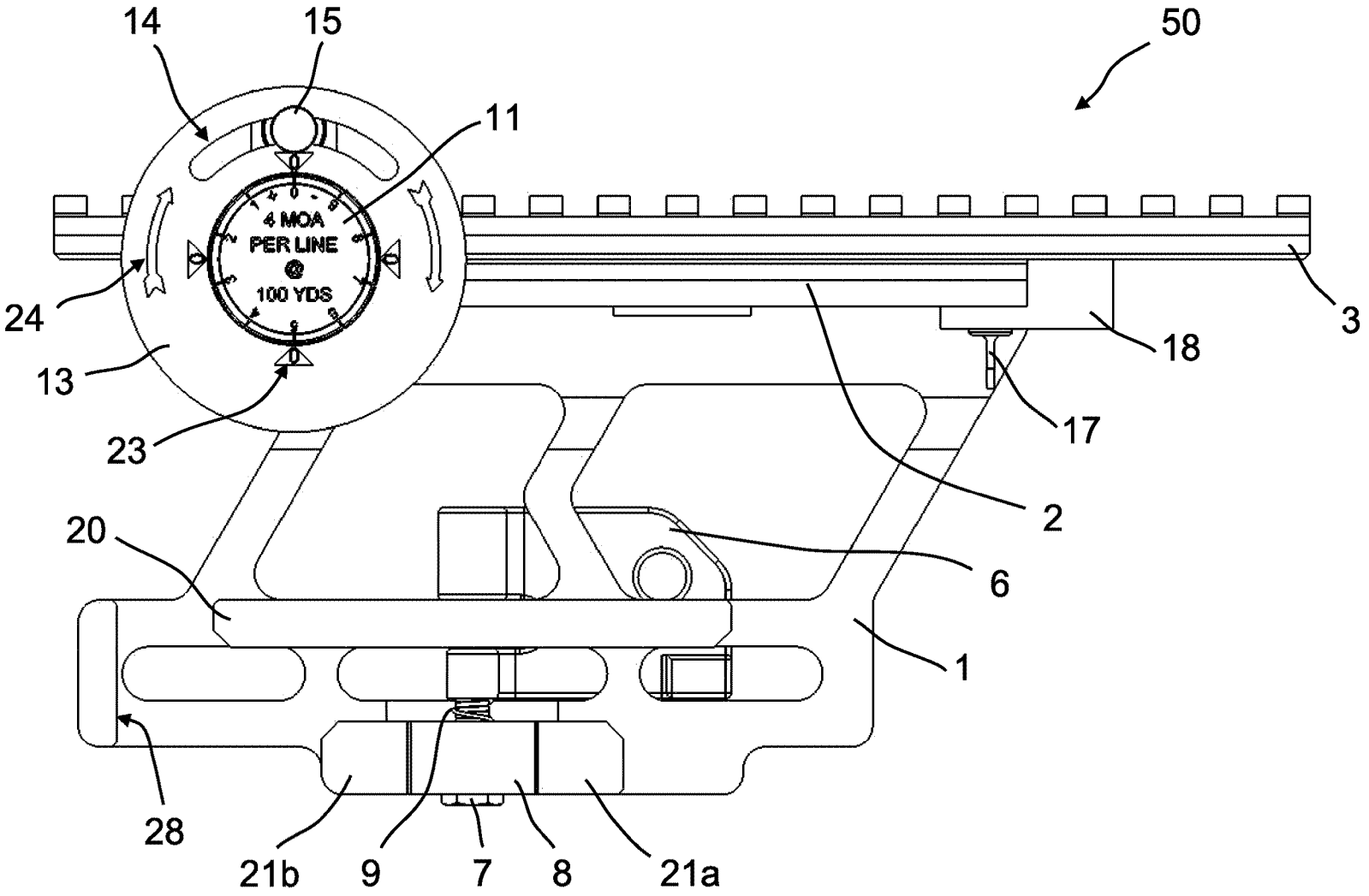
FIG. 4 is a left-side view of an embodiment of a windage-adjustable optics mount with an external windage adjustment tool similar to what is shown in FIG. 3.
Figures 5A, 5B, 5C:
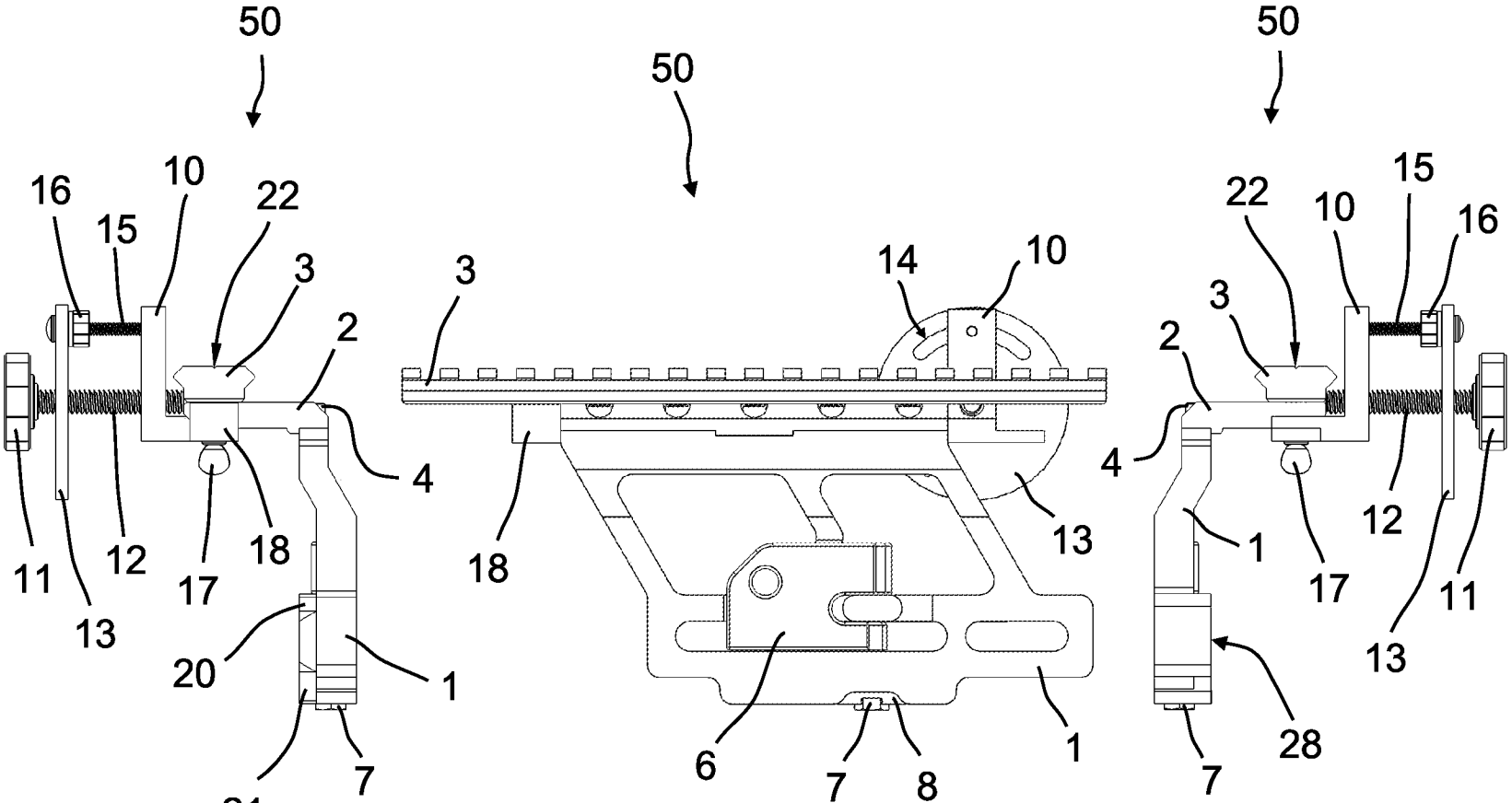
FIGS. 5A, 5B and 5C illustrate a front view, a left-side view, and a rear-side view, respectively, of an embodiment of an optics mount with an external windage adjustment tool similar to what is shown in FIG. 3.

In an embodiment shown in FIG. 4, dial knob 11 may be provided with 0 to 9 numeral markings displayed in increasing order moving in a clockwise direction along the circumference. In one preferred embodiment, dial knob 11 may be provided with inscriptions specifying the magnitude of lateral adjustment to rail 3 that is available when knob 11 is turned between adjacent lines in a clockwise direction. The magnitude of adjustment may be proportional to the pitch of adjustment screw 12. Disk 13 may be marked with a plurality of zeroing triangles 23 and a pair of directional arrows 24. Zeroing triangles 23 may be used to establish the initial position of adjustment screw 12 before performing further windage adjustments, and arrows 24 may be used to indicate the direction in which dial knob 11 may be turned, embodiments of which will be explained subsequently in connection with FIGS. 16-17, FIGS. 20-21 and FIGS. 24-25.

In some embodiments, optics mount 50 may be secured to a side rail 48 of a firearm (shown, for example, in FIG. 29) with an adjustable clamping mechanism. In one embodiment, as illustrated in FIGS. 7-10, the clamping mechanism comprises upper rail 20, front guide rail 21*a*, rear guide rail 21*b*, clamp 8, screw 7, compression spring 9, rotating latch 6 and spring plunger 29. Stop shoulder 28 may contact a rear portion (not shown) of side rail 48, thereby ensuring that the clamping mechanism is completely positioned axially over the firearm's side rail (as illustrated, for example, in FIGS. 29-30). Clamp 8 and compression spring 9 may be installed over screw 7, and rotating latch 6 may be positioned onto first engaging member 1 having threaded hole 57 aligned with hole 54. Clamp 8 may be inserted between front guide rail 21*a* and rear guide rail 21*b*. Screw 7 may be inserted through hole 54 and screwed into threaded hole 57 of rotating latch 6, thereby compressing spring 9. Spring 9 may be compressed by turning screw 7 clockwise until at least one lower side of the clamp 8 is aligned with at least one lower side of front guide rail 21 a and lower rear guide rail 21*b*. The alignment of clamp 8 with front guide rail 21 a and rear guide rail 21*b* can be incrementally adjusted by indexing the position of screw 7 using clockwise or counterclockwise turns. Turning rotating latch 6 counterclockwise may partially unscrew screw 7, thereby allowing compression spring 9 to push down on clamp 8 and to increase the distance between clamp 8 and upper rail 20, which in turn may permit optics mount 50 to slidably engage and disengage a firearm's side rail 48 (as indicated by the directional key 85 in FIG. 28). Turning rotating latch 6 clockwise may reduce the distance between clamp 8 and upper rail 20, consequently exerting a clamping force onto a firearm's side rail 48 that securely attaches optics mount 50 to a firearm. The nose of spring plunger 29 installed into threaded hole 56 of first engaging member 1 may snap into a concave dimple (not shown) in the lower side of rotating latch 6, thereby preventing any unintentional counterclockwise rotation of rotating latch 6 and the loosening of the resulting clamping force.

Figure 3:
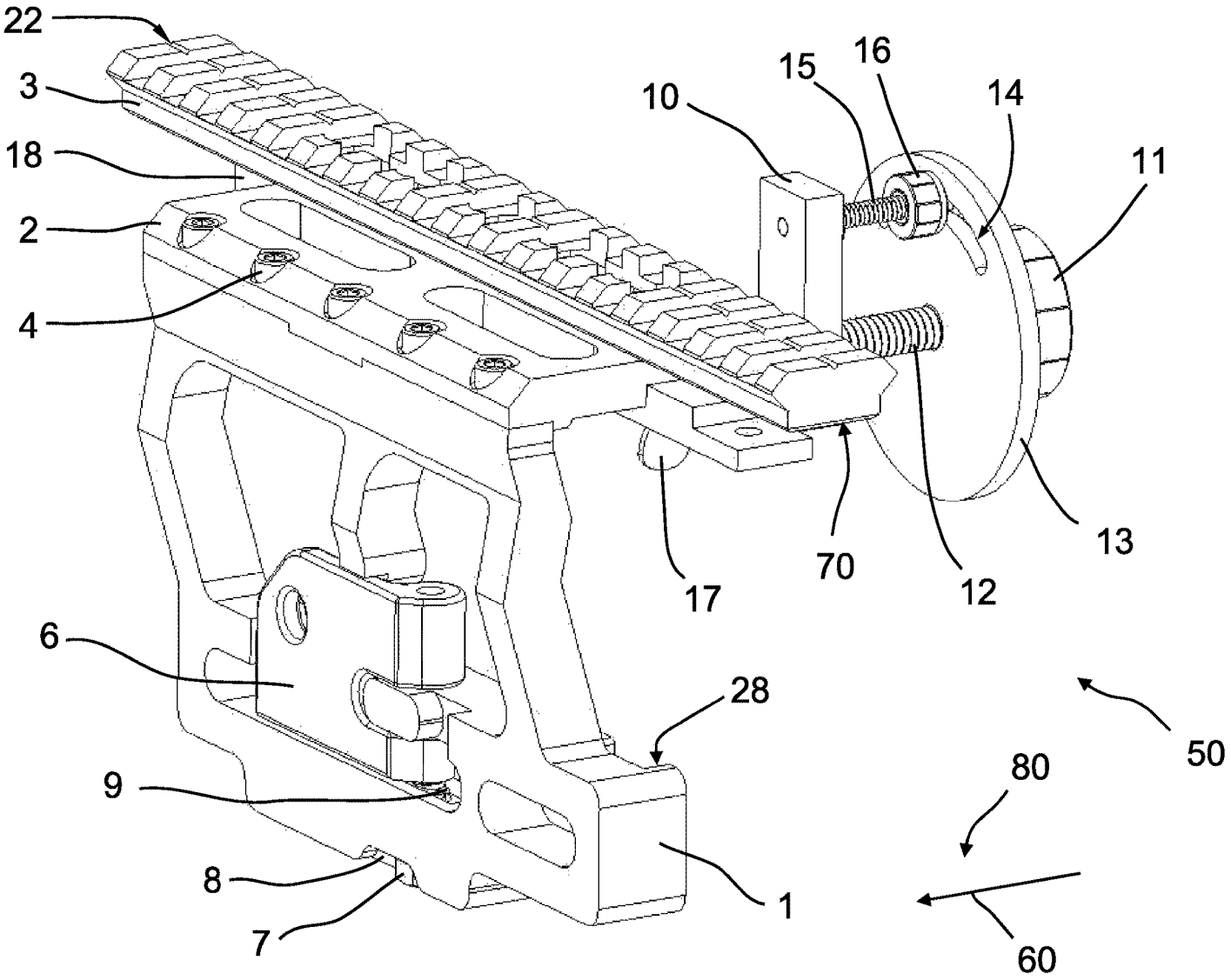
FIG. 3 is an elevated left-side perspective view of one embodiment of a windage-adjustable optics mount with an external windage adjustment tool, shown together with a directional key, where an external windage adjustment tool is situated in a position that allows for windage adjustment in a direction indicated by the key.
Figure 28:
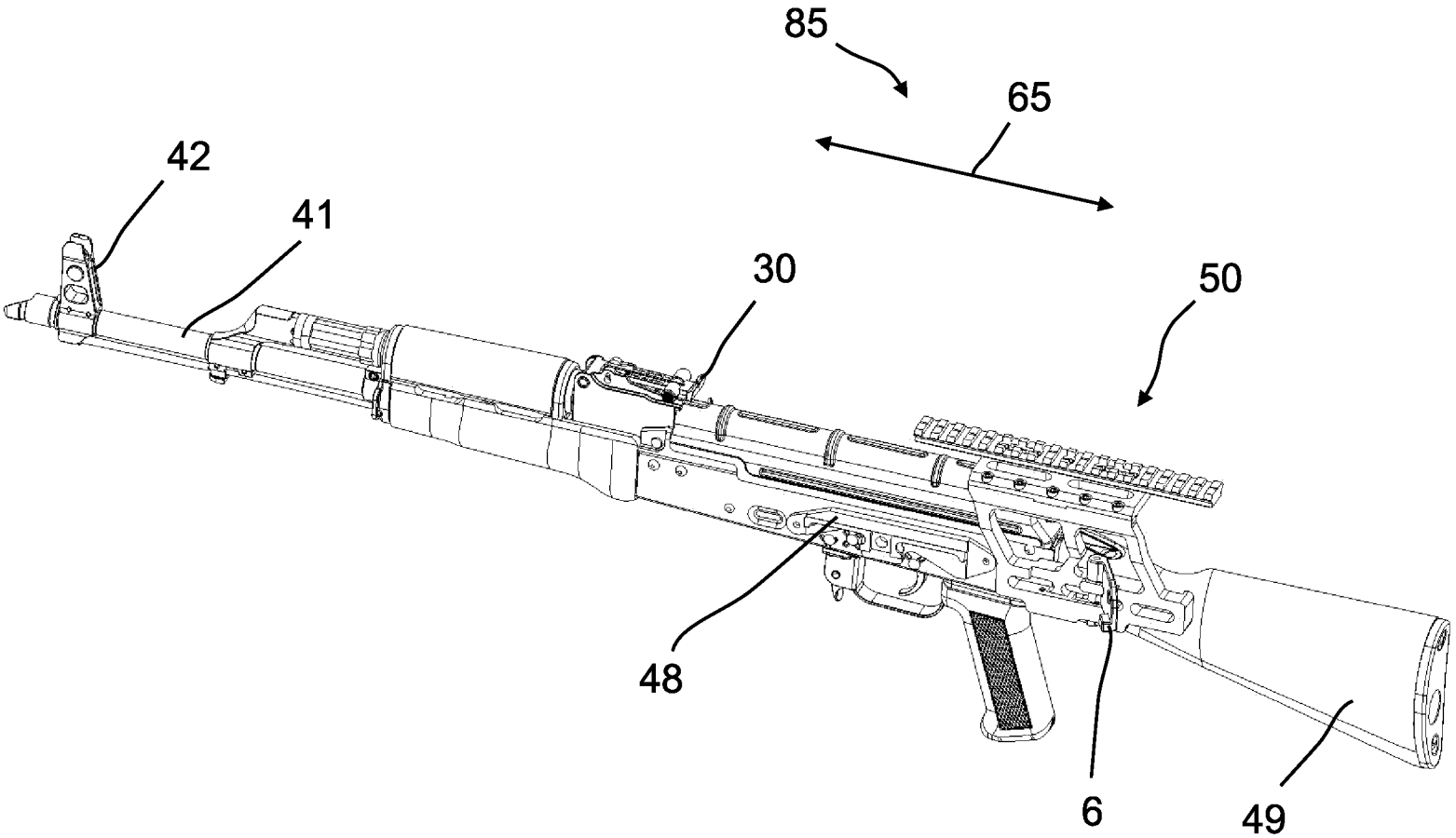
FIG. 28 is an elevated perspective view of an embodiment of a firearm shown together with an embodiment of a windage-adjustable optics mount similar to what is shown in FIG. 1 but in a pre-engagement position and with no external windage adjustment tool present.
Figure 29:
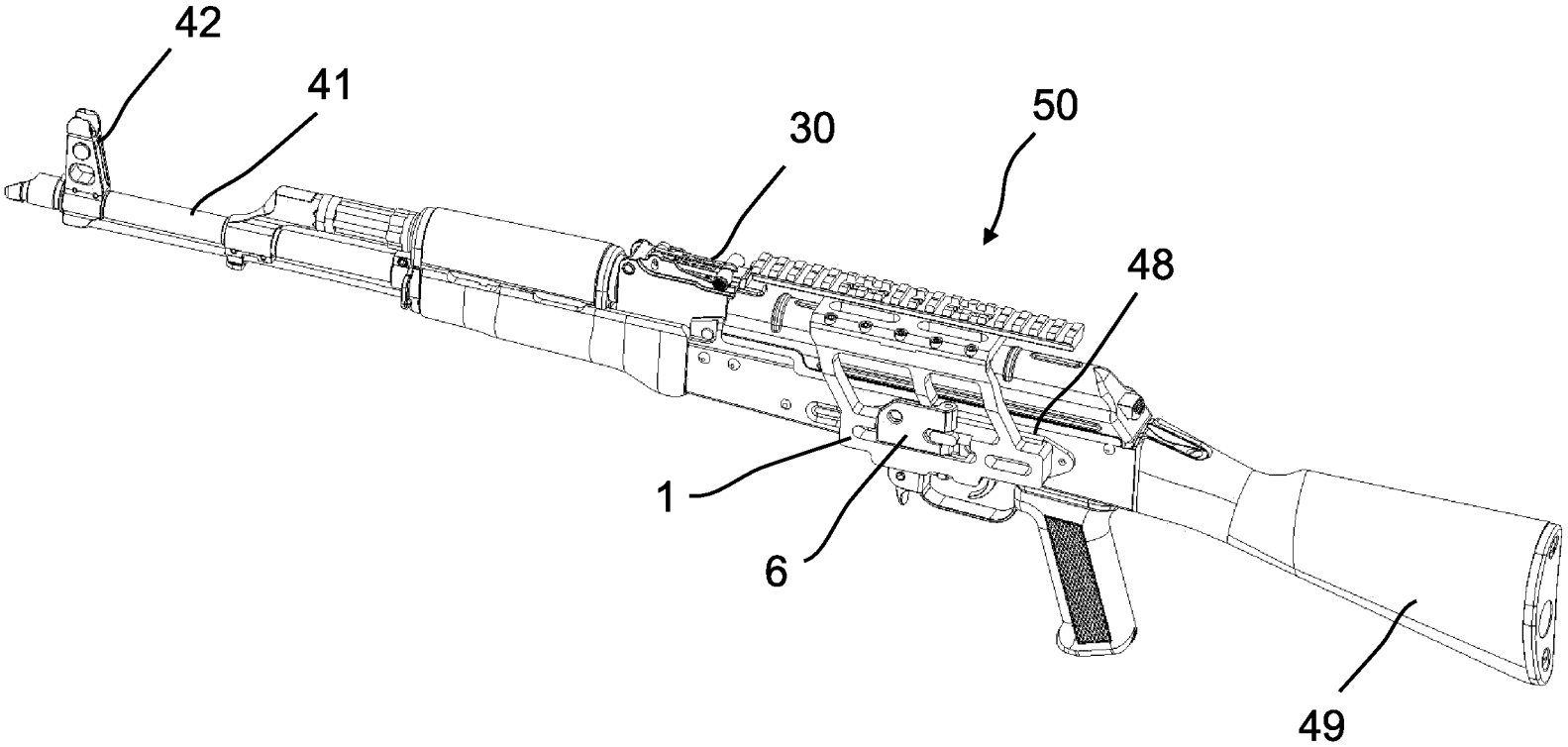
FIG. 29 illustrates an embodiment of a windage-adjustable optics mount similar to what is shown in FIG. 1 but with no external windage adjustment tool present, and shown in a fully engaged position with a firearm.

Referring to FIG. 28, to attach an optics mount to a firearm, in some embodiments the user may first turn rotating latch 6 in a counterclockwise direction and then slidably engage optics mount 50 with side rail 48 of a firearm by pushing optics mount 50 towards the firearm's barrel 41 in an axial direction 65 of the directional key 85, until stop shoulder 28 (shown, for example, in FIGS. 2 through 4) contacts a rear portion (not shown) of side rail 48, thereby preventing any further movement of optics mount 50. Then the user may turn rotating latch 6 in the clockwise direction until it snaps over the nose of spring plunger 29, thereby enabling the clamping mechanism to firmly secure optics mount 50 to side rail 48 of the firearm (as shown in FIG. 29).

When scope mount 50 is installed on the firearm for the first time, the user may verify the alignment of notch 22 of Picatinny rail 3 with notch 31 of the firearm's rear sight 30. Also, the user may verify the alignment of markings 26 on Picatinny rail 3 with at least one of the markings 27 on second engaging member 2 of optics mount 50 (as shown in FIGS. 31-32). In some embodiments, the alignment can be achieved by first loosening the plurality of screws 5, then repositioning Picatinny rail 3 on second engaging member 2 by aligning notch 22 with notch 31 of the firearm's rear sight 30, then verifying the alignment of markings 26 with at least one of the markings 27 on second engaging member 2 of optics mount 50 (as shown in FIGS. 31-32), and then finally tightening back the plurality of screws 5. The aiming device, exemplified in FIG. 30 as an electro-optic sight 43, then can be mounted to Picatinny rail 3 of windage-adjustable scope mount 50.

In some embodiments, an external windage adjustment tool can be utilized to correct a windage misalignment between the line of sight of the aiming device and the axis of the firearm's barrel that cannot be satisfactorily corrected using the internal mechanism of the aiming device.

It is generally understood in the art that by shooting at a target and then measuring the horizontal distance between the point of aim and the point where the projectile hit the target (also known as the point of impact), the user can determine the amount of windage correction needed in an aiming device of a firearm, including an aiming device mounted to a firearm by way of the present invention. It should be noted that depending on the direction of the windage misalignment between the line of sight of the aiming device and the axis of the firearm's barrel, the projectile may hit the target either to the left or to the right relative to the point of aim.

Figure 30:
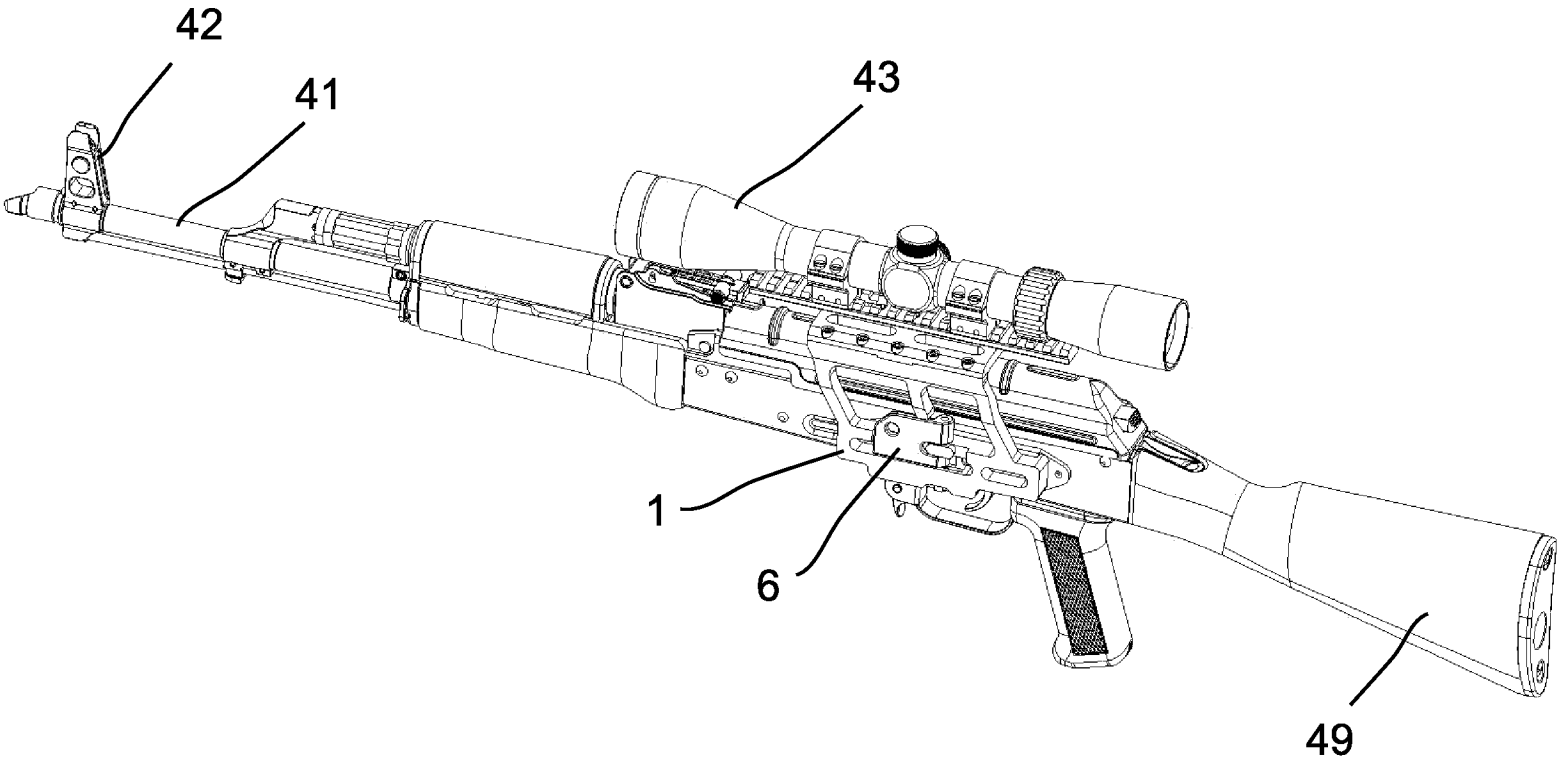
FIG. 30 illustrates an embodiment of the windage-adjustable optics mount of FIG. 1 with no external windage adjustment tool present and with a mounted electro-optic sight, and shown in a fully engaged position with a firearm.

It is generally understood in the art that the internal elevation and windage adjustment mechanisms of aiming devices, such as the electro-optic sight 43 exemplified in FIG. 30, can be calibrated for incremental adjustments in units or fractions of units called Minute of Angle (also known as MOA). MOA is an angular measurement of the elevation or windage of a projectile's actual trajectory to a point of impact on a target relative to a hypothetical straight-line trajectory to the point of aim on a target, wherein the angles of elevation or windage are measured from the hypothetical straight-line trajectory to the actual trajectory of the projectile. As a practical matter, because the deviation of the point of impact relative to the point of aim can be measured only as a linear dimension on the target (i.e. the linear distance between the point of aim and the point of impact), the linear measurement must be converted to an MOA compatible with the adjusting mechanism of an aiming device before the user can adjust the aiming device. The practical conversion rule is that 1 MOA equates to 1 inch of linear distance on a target per 100 yards of distance between the target and the aiming device. For example, when the target is placed 50 yards away from the aiming device, 1 MOA corresponds to 0.5 inches of distance measured on the target between the point of aim and the point of impact. When the target is placed 100 yards away from the aiming device, 1 MOA corresponds to 1 inch of distance measured on the target between the point of aim and the point of impact. When the target is placed 200 yards away from the aiming device, 1 MOA corresponds to 2 inches distance measured on the target between the point of aim and the point of impact.

It is generally understood in the art that that after mounting an aiming device to a firearm and aligning the aiming device with the barrel, the elevation and windage adjustment mechanisms of the aiming device should be "zeroed," thereby giving the user optimum capability to adjust the elevation or windage of the aiming device. It is generally understood in the art that if the elevation and windage adjustment mechanisms of an aiming device are not zeroed with the alignment with the barrel, a user may encounter a phenomenon known as "running out of adjustments." It is generally understood in the art that before starting a windage adjustment procedure, the user may measure the distance between the point of aim and the point of impact on the target, convert the distance to MOA, and take note of the position of the point of impact, either left or right, relative to the point of aim. In some embodiments of the present invention, an external windage adjustment tool is calibrated for MOA adjustments (as shown, for example, in FIG. 4), thereby allowing an external windage adjustment tool to be utilized to move the anticipated point of impact towards the point of aim until the two points coincide.

Figure 16:
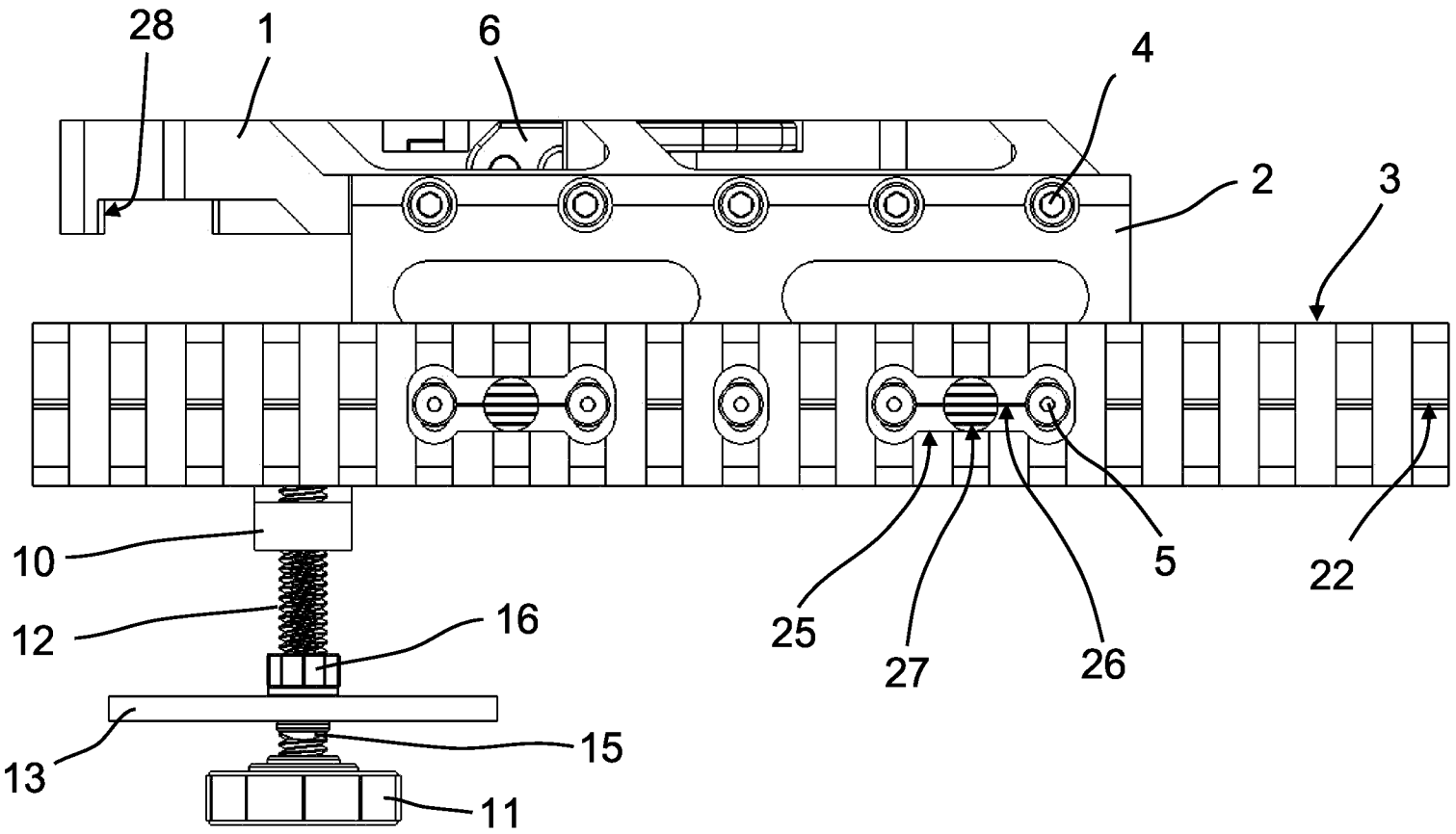
FIG. 16 illustrates a top view of an embodiment of a windage-adjustable optics mount with an external windage adjustment tool similar to what is shown in FIG. 4.
Figure 17:
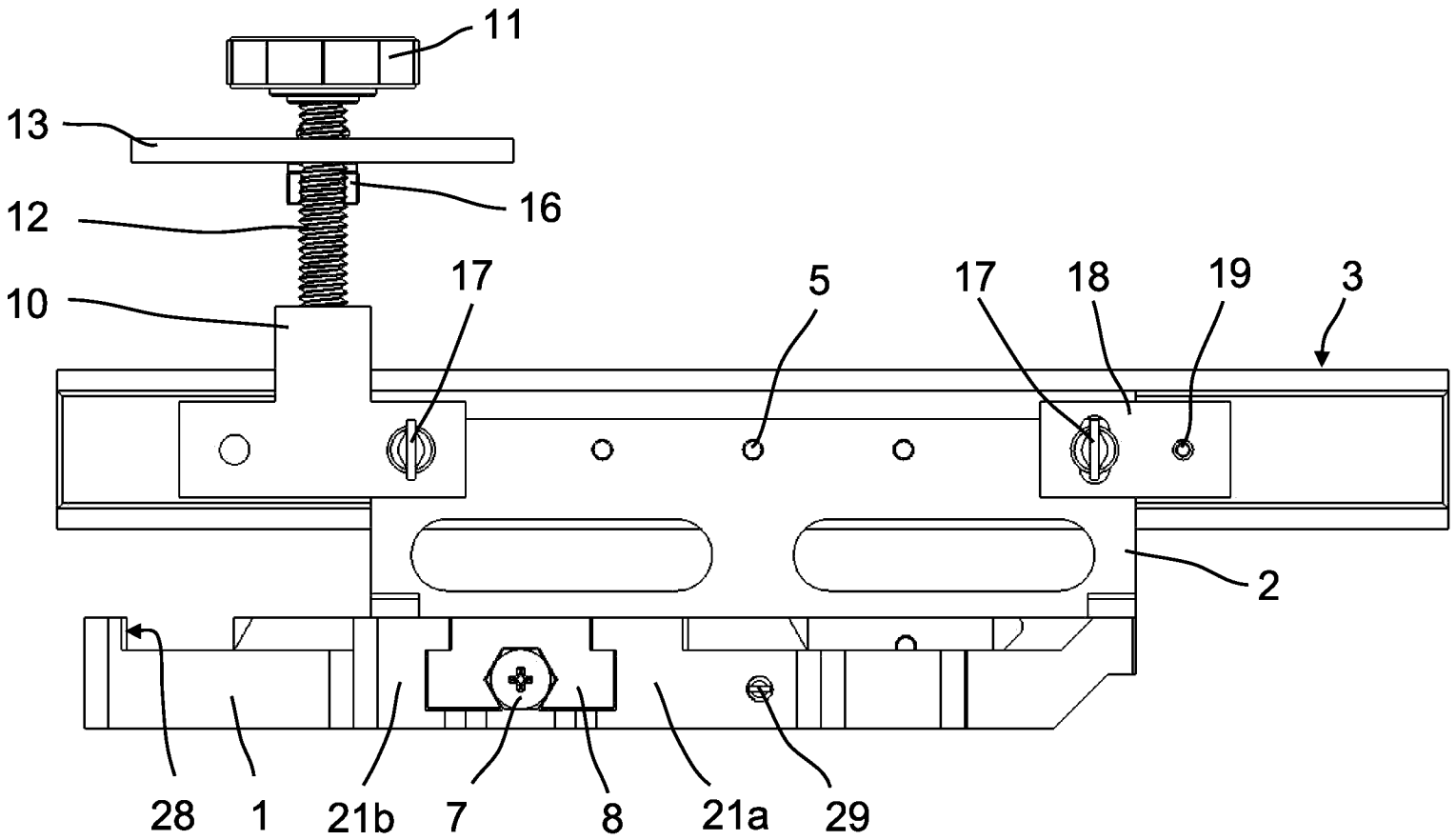
FIG. 17 illustrates a bottom view of an embodiment of a windage-adjustable optics mount with an external windage adjustment tool similar to what is shown in FIG. 4.
Figure 18:
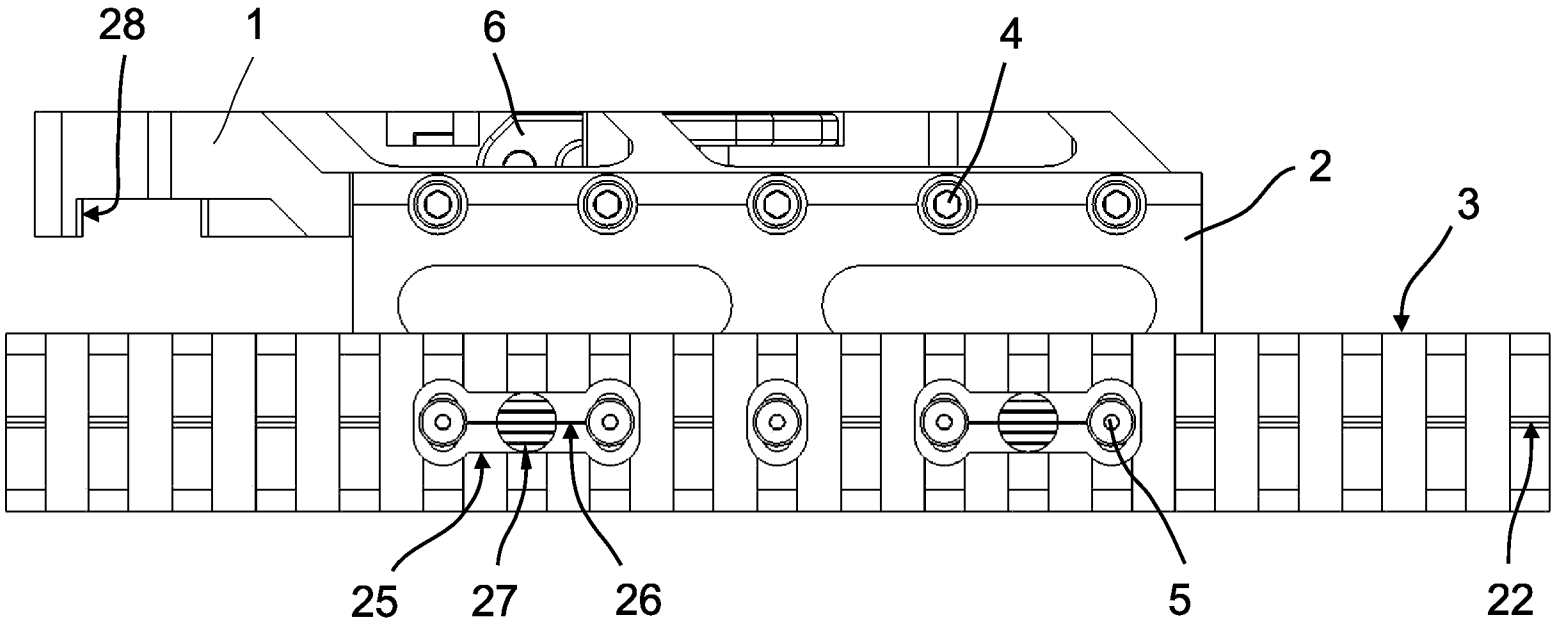
FIG. 18 illustrates a top view of an embodiment of a windage-adjustable optics mount similar to what is shown in FIG. 4 but with no external windage adjustment tool present.
Figure 19:
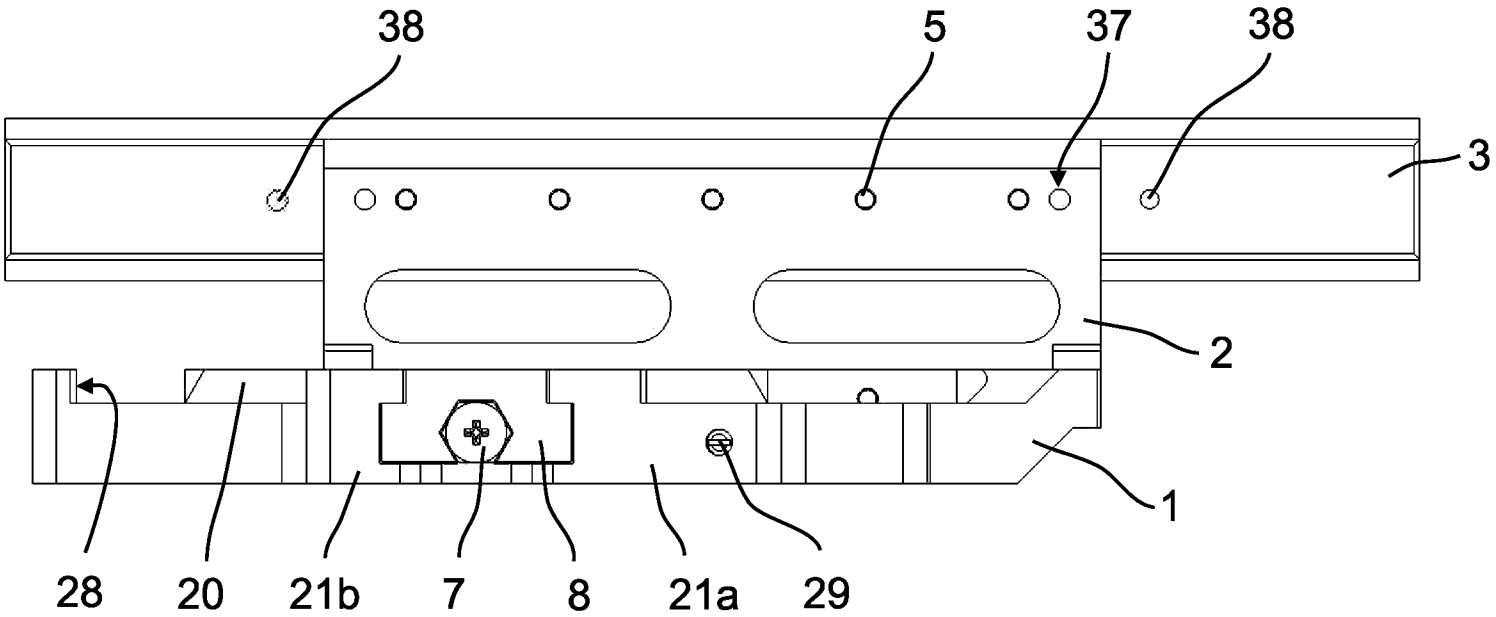
FIG. 19 illustrates a bottom view of an embodiment of a windage-adjustable optics mount similar to what is shown in FIG. 4 but with no external windage adjustment tool removed.

In some embodiments, the zeroing process, the process of zeroing the windage adjustments of the present invention as are follows. Scope mount 50 may be first removed from the firearm and the aiming device may be removed from the scope mount. Then, as shown for example in FIG. 6B, the front subassembly may be attached to the front end of scope mount 50 by inserting the top end of pivot screw 19 into hole 38 of Picatinny rail 3, and then fastening bracket 18 to second engaging member 2 with thumb screw 17. The rear subassembly then may be attached to scope mount 50 by fastening the two-way mounting bracket 10 to second engaging member 2 with thumb screw 17. Adjustment screw 12 may be screwed through threaded hole 51 (shown in FIG. 7) of the two-way mounting bracket 10 by turning the dial knob 11 clockwise until dial knob 11 contacts Picatinny rail 3 (illustrated, for example, in FIG. 1). Then disk 13 is zeroed by turning it either in the clockwise or counterclockwise direction until one of the zeroing triangles 23 lines up with any of the 0 to 9 numeral markings on dial knob 11 (illustrated, for example, in FIG. 4). Disk 13 then may be fixed in the zero position by tightening thumb nut 16 against the head of screw 15. FIGS. 16-17 illustrate embodiments of the windage adjustment tool with scope mount 50 in a position preceding the beginning of the windage adjustment procedure. Screws 5 then may be loosened slightly, sufficient to allow pivoting of rear end 70 of Picatinny rail around pivot screw 19 by turning dial knob 11 clockwise. In this embodiment, the above-described example of a zeroing process would allow the user to adjust the windage in MOA or fractions of MOA increments, as necessary, by turning dial knob 11 in a clockwise direction, using the 0 to 9 numeral markings in reference to the zero position. For example, in one embodiment illustrated in FIG. 4, a clockwise rotation of dial knob 11 from the 0 mark to the 1 mark adjusts the windage by 4 MOA, which results in moving the point of impact by 4 inches on a target placed 100 yards away from the shooter.

Figure 20:
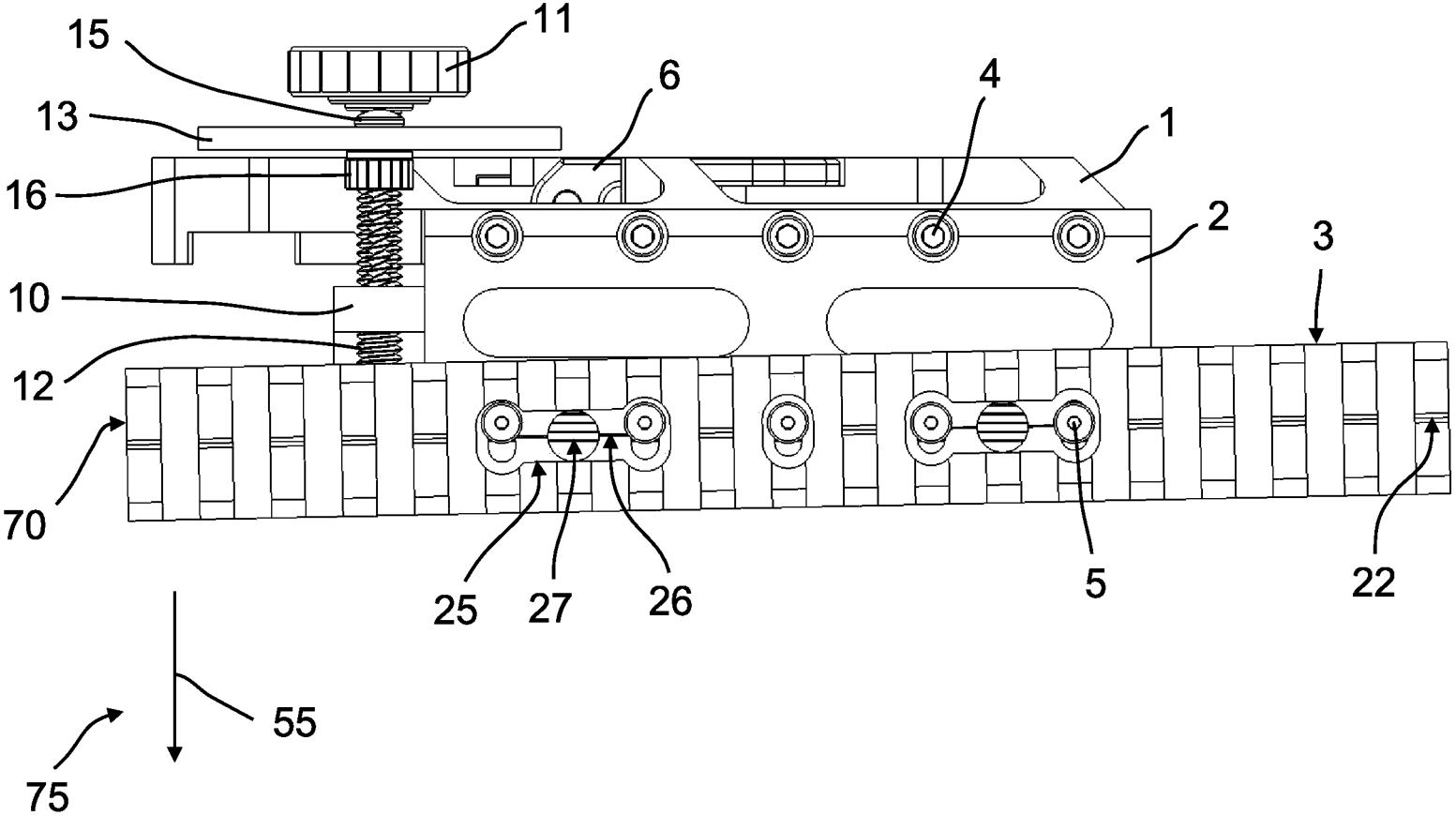
FIG. 20 illustrates a top view of an embodiment of a windage-adjustable optics mount with an external windage adjustment tool, shown together with a directional key, where the windage may be adjusted by pushing a rear end of a Picatinny rail in a direction indicated by the key using an external windage adjustment tool.
Figure 21:
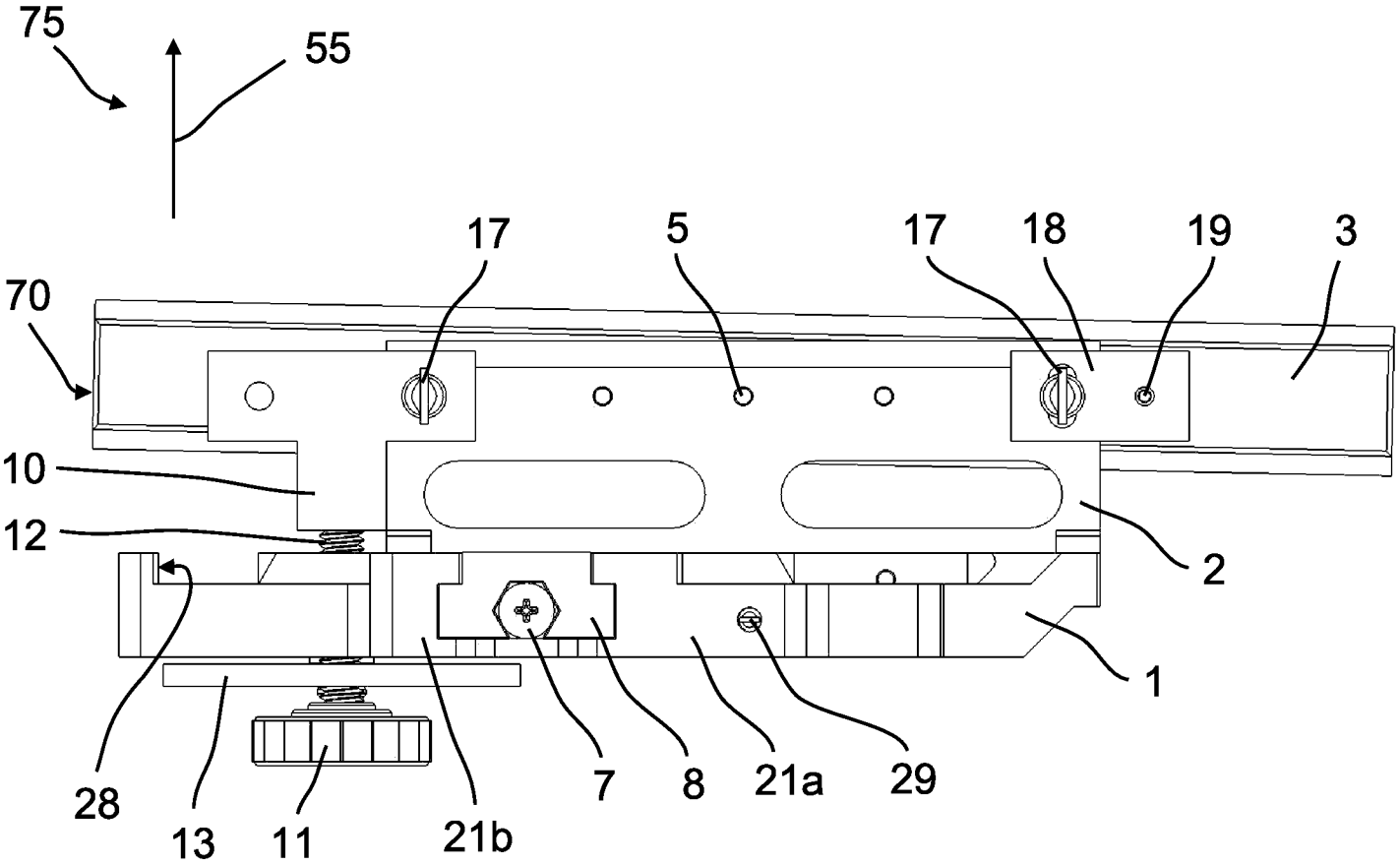
FIG. 21 illustrates a bottom view of an embodiment of a windage-adjustable optics mount with external windage adjustment tool, shown together with a directional key, where the windage may be adjusted by pushing a rear end of a Picatinny rail in a direction indicated by the key using an external windage adjustment tool.
Figure 24:
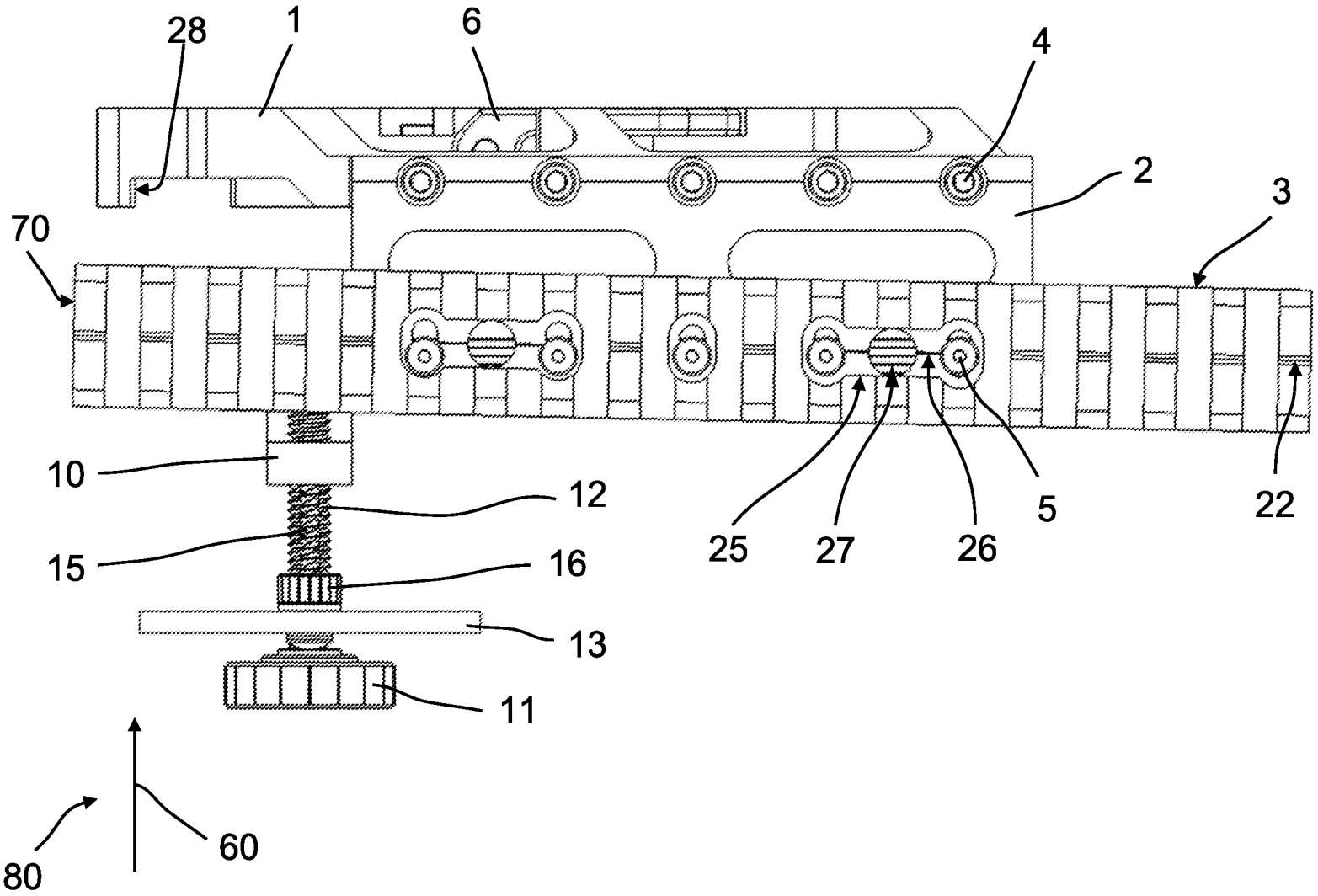
FIG. 24 illustrates a top view of an embodiment of a windage-adjustable optics mount with an external windage adjustment tool, shown together with a directional key, where the windage may be adjusted by pushing a rear end of a Picatinny rail in a direction indicated by the key using an external windage adjustment tool.
Figure 25:
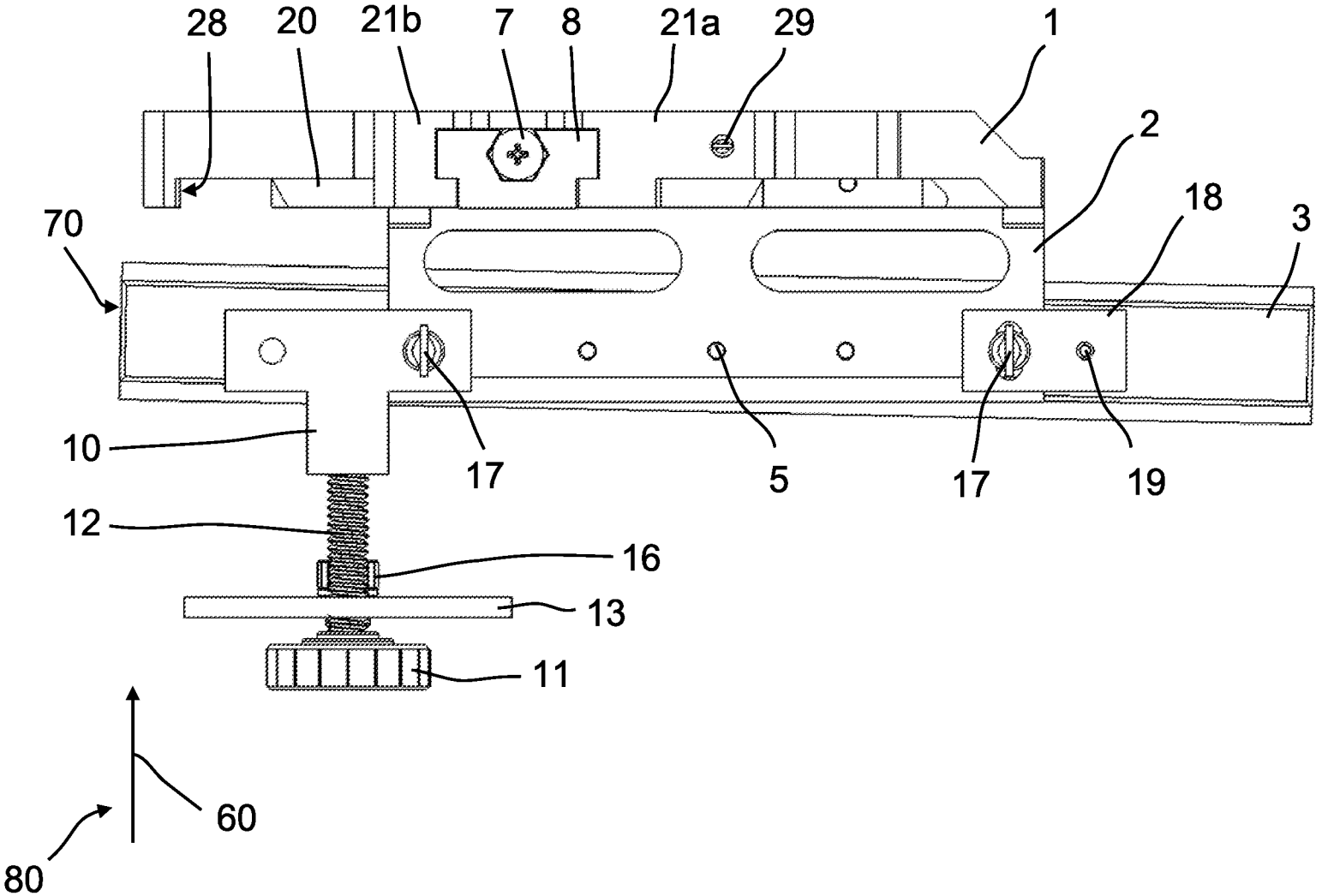
FIG. 25 illustrates a bottom view of an embodiment of a windage-adjustable optics mount with an external windage adjustment tool, shown together with a directional key, where the windage may be adjusted by pushing a rear end of a Picatinny rail in a direction indicated by the key using an external windage adjustment tool.
Figure 35A:
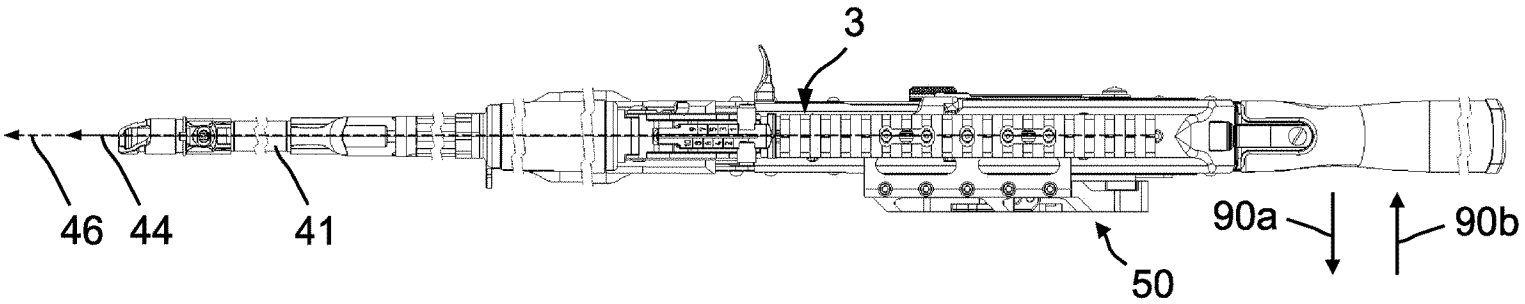
FIG. 35A is a top view of an embodiment of a windage-adjustable mount in a fully engaged position with a firearm similar to what is illustrated in FIG. 29, showing an axis of a Picatinny rail in a position coincident with an axis of a firearm's barrel, shown together with a directional key.

The positioning of the rear subassembly on the left side or on the right side of scope mount 50 depends on the direction in which the user needs to move the point of impact. It should be noted that the foregoing terms "left side" and "right side" are based upon orientation of optics mount 50 when secured to a firearm as illustrated in FIG. 35A, where the left side is indicated by the direction 90*a* and the right side is indicated by the direction 90*b*. FIGS. 20-21 illustrate an embodiment of a rear subassembly being positioned on the left side of the scope mount, which allows for the moving the point of impact to the right by pushing rear end 70 of Picatinny rail 3 in the direction 55 indicated by the directional key 75. FIGS. 24-25 illustrate an embodiment of a rear subassembly being positioned on the right side of the scope mount, which allows for the moving the point of impact to the left by pushing rear end 70 of Picatinny rail 3 in the direction 60 indicated by the directional key 80.

After adjusting the windage, screws 5 may be tightened to lock Picatinny rail 3 in place on second engaging member 2, and the windage adjustment tool may be removed from the scope mount 50.

Figure 22:
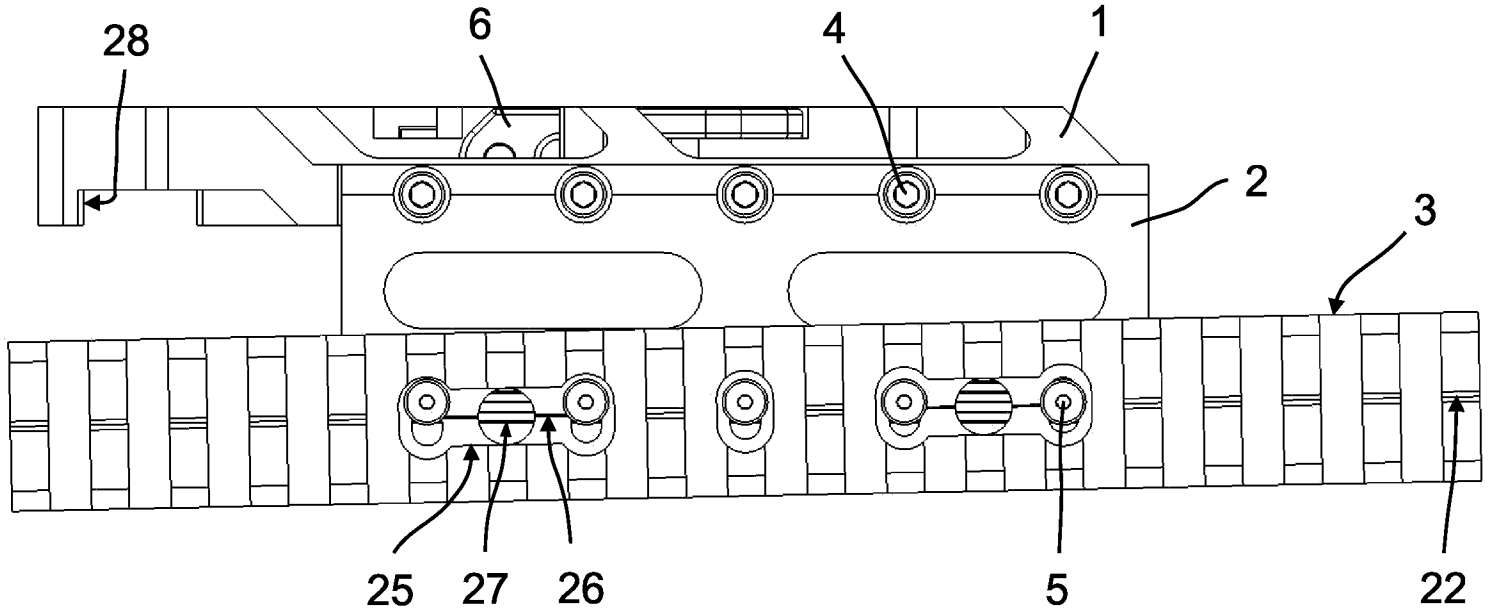
FIG. 22 is a top view of an embodiment of a windage-adjustable optics mount similar to what is shown FIG. 20 but with no external windage adjustment tool present.
Figure 23:
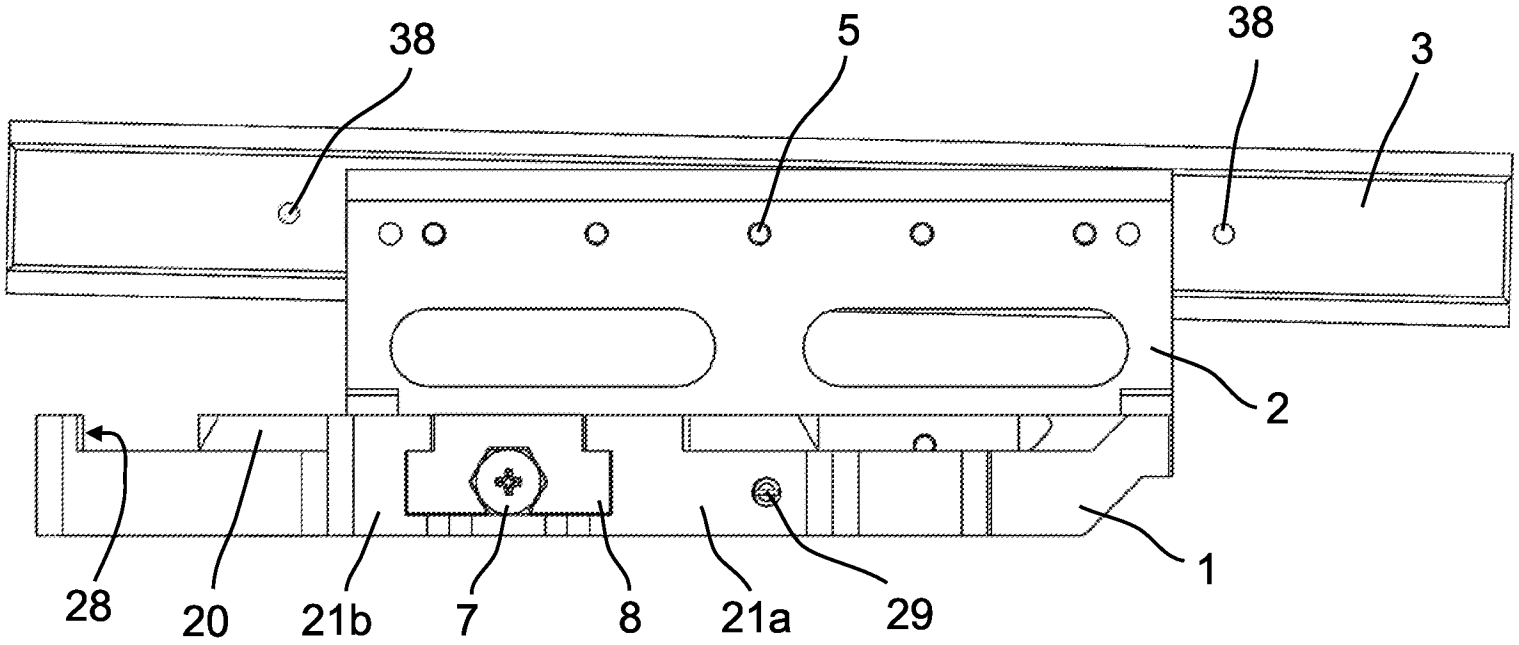
FIG. 23 is a bottom view of an embodiment of a windage-adjustable optics mount similar to what is shown in FIG. 21 but with no external windage adjustment tool present.
Figure 26:
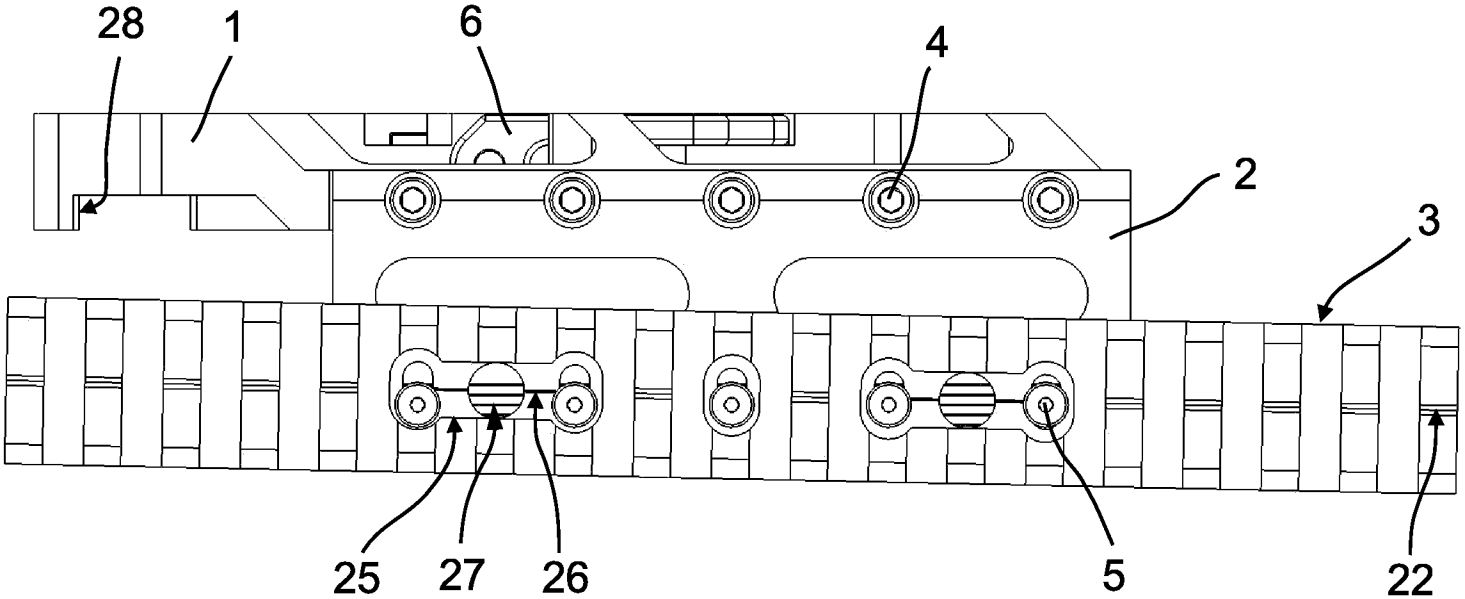
FIG. 26 is a top view of an embodiment of a windage-adjustable optics mount similar to what is shown in FIG. 24 but with no external windage adjustment tool present.
Figure 27:
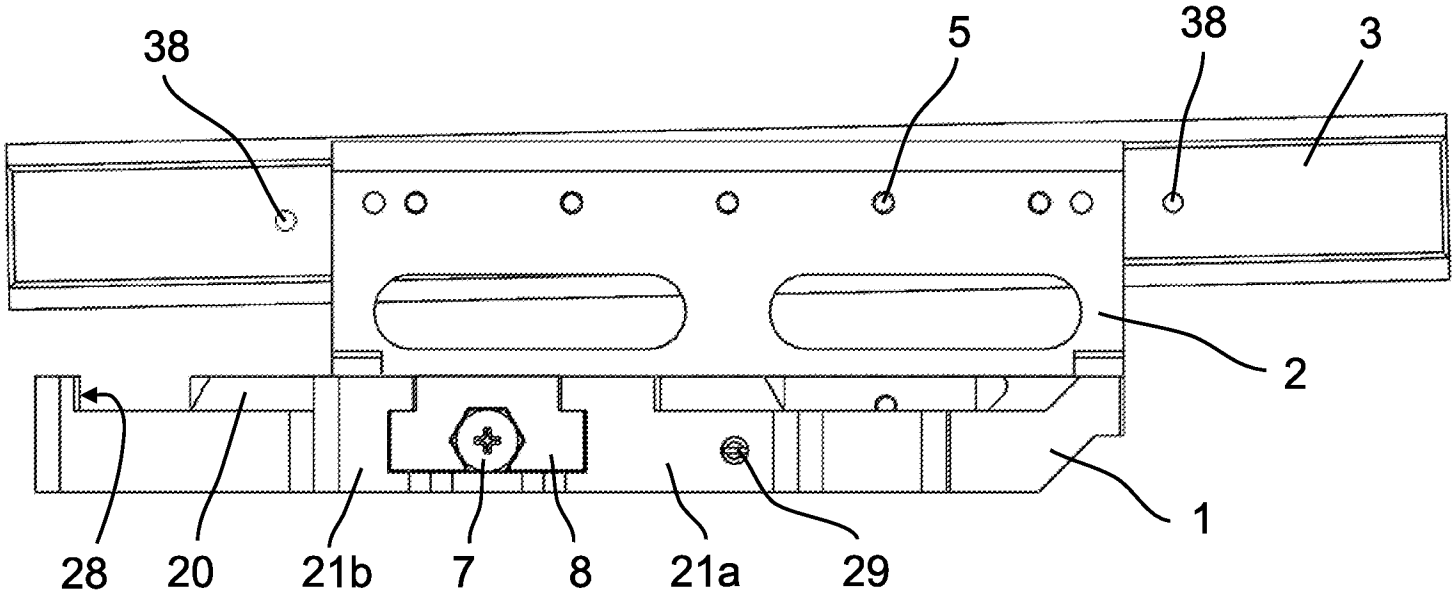
FIG. 27 is a bottom view of an embodiment of a windage-adjustable optics mount similar to what is shown in FIG. 25 but with no external windage adjustment tool present.

FIGS. 22-23 illustrate an example of scope mount 50 after a specific windage correction resulting in moving the point of impact to the right was made, and the windage adjustment tool was removed. FIGS. 26-27 illustrate embodiments of scope mount 50 after a specific windage correction was performed that resulted in moving the point of impact to the left, and after the windage adjustment tool was removed.

Figure 35B:
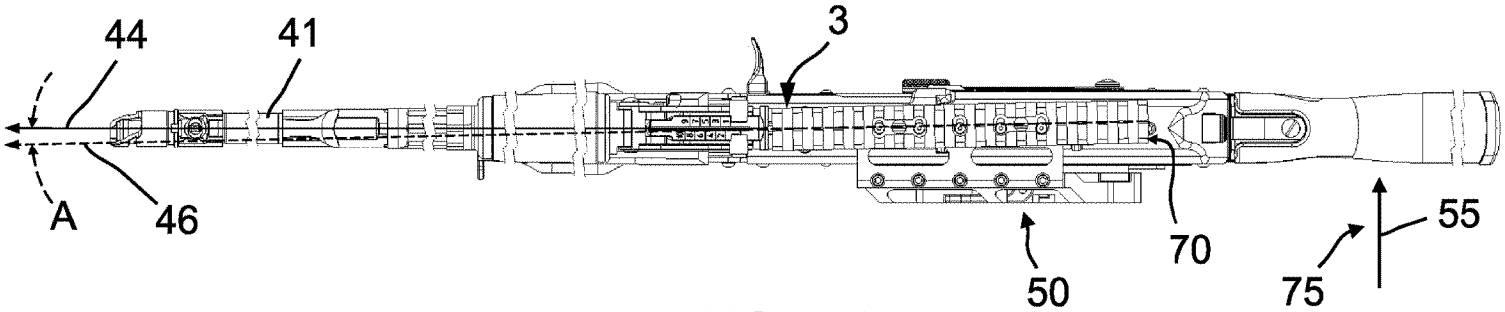
FIG. 35B is a top view of an embodiment of a windage-adjustable mount in a fully engaged position with a firearm similar to what is illustrated in FIG. 29, together with a directional key, showing a windage adjustment that may be achieved by pushing a rear end of a Picatinny rail in a direction indicated by the key using an external windage adjustment tool.
Figure 35C:
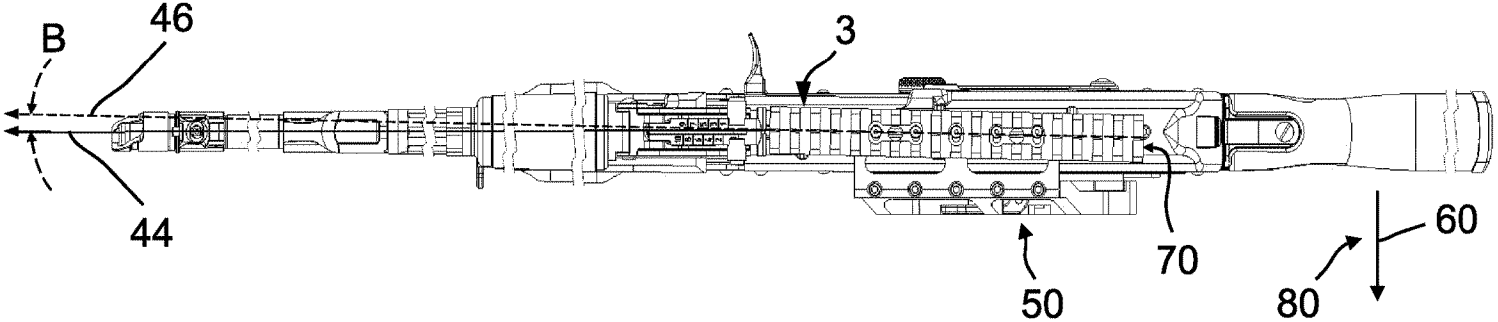
FIG. 35C is a top view of an embodiment of a windage-adjustable mount in a fully engaged position with a firearm similar to what is illustrated in FIG. 29, shown together with a directional key, showing a windage adjustment that may be achieved by pushing a rear end of a Picatinny rail in a direction indicated by the key using an external windage adjustment tool.

In some embodiments, after removing the windage adjustment tool, scope mount 50 may be reinstalled on side rail 48 of the firearm, as shown in FIGS. 33-34 and FIGS. 35B-35C. As illustrated in FIG. 35B, adjusting the windage of Picatinny rail 3 in the direction 55 indicated by the directional key 75 results in moving the point of impact to the right by an MOA value "A", measured in between the line of sight 46 and axis 44 of the firearm's barrel. As illustrated in FIG. 35C, adjusting the windage of Picatinny rail 3 in direction 60 indicated by the directional key 80 results in moving the point of impact to the left by an MOA value "B", measured in between the line of sight 46 and axis 44 of the firearm's barrel.

In some embodiments, an aiming device exemplified in FIG. 30 as an electro-optic sight 43 can be mounted to a Picatinny rail of a windage-adjustable scope mount 50.

The present invention thus provides for windage adjustment of an aiming device mounted on a firearm while preserving the adjustment range of the internal mechanism of the aiming device.

The present invention also advantageously provides for windage adjustment when needed while being usable with firearms and aiming devices requiring no windage corrections.

The above description is illustrative of the preferred embodiment and many modifications may be made by those skilled in the art without departing from the spirit of the present invention.

What is claimed is:

1. An adjustable mount system for aiming devices comprising:

a base member configured to attach to a firearm;

a rail configured to attach to an aiming device and further configured to pivotably attach to a pivot point on the base member;

wherein the base member further comprises a first alignment marking, and wherein the rail further comprises a second alignment marking; and at least one viewing hole configured to make visible the first alignment marking when the rail is pivotably attached to a pivot point on the base member.

2. The adjustable mount system of claim 1, further comprising an adjustment tool configured to engage the rail so as to rotate the rail about the pivot point.

3. The adjustable mount system of claim 2, wherein the base member further comprises a first alignment marking, and wherein the rail further comprises:

a second alignment marking; and at least one viewing hole configured to make visible the first alignment marking when the rail is pivotably attached to a pivot point on the base member.

4. The adjustable mount system of claim 2, wherein the rail further comprises a first region, and wherein the adjustment tool is configured to mechanically engage the first region so as to pivot the first region about the pivot point.

5. The adjustable mount system of claim 4, wherein the adjustment tool further comprises an adjustment screw that engages the first region.

6. The adjustable mount system of claim 4, wherein the base member further comprises a first alignment marking, and wherein the rail further comprises:

a second alignment marking; and at least one viewing hole configured to make visible the first alignment marking when the rail is pivotably attached to a pivot point on the base member.

* * * * *